US009439453B2

(12) United States Patent
Conner et al.

(10) Patent No.: US 9,439,453 B2
(45) Date of Patent: *Sep. 13, 2016

(54) SEGMENTED SMOKING ARTICLE WITH SUBSTRATE CAVITY

(71) Applicant: R.J. Reynolds Tobacco Company, Winston-Salem, NC (US)

(72) Inventors: Billy Tyrone Conner, Clemmons, NC (US); Andries Don Sebastian, Clemmons, NC (US); Evon Llewellyn Crooks, Mocksville, NC (US); Timothy Frederick Thomas, High-Point, NC (US); James Richard Stone, Advance, NC (US); Chandra K. Banerjee, Clemmons, NC (US); Yi-Ping Chang, Greensboro, NC (US); Vernon Brent Barnes, Advance, NC (US); Alvaro Gonzalez-Parra, Clemmons, NC (US); David Neil McClanahan, Winston-Salem, NC (US); Carolyn R. Carpenter, Lewisville, NC (US); Timothy B. Nestor, Advance, NC (US); Jackie L. White, Pfafftown, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/835,441

(22) Filed: Aug. 25, 2015

(65) Prior Publication Data

US 2015/0359259 A1 Dec. 17, 2015

Related U.S. Application Data

(63) Continuation of application No. 13/236,962, filed on Sep. 20, 2011, now Pat. No. 9,149,072, which is a continuation-in-part of application No. 12/775,130, filed on May 6, 2010, now Pat. No. 8,839,799, and a (Continued)

(51) Int. Cl.
*A24F 47/00* (2006.01)
*A24D 1/08* (2006.01)

(Continued)

(52) U.S. Cl.
CPC ..... *A24D 1/08* (2013.01); *A24B 15/165* (2013.01); *A24C 5/00* (2013.01); *A24F 47/006* (2013.01)

(58) Field of Classification Search
CPC .. A24F 47/002; A24F 47/004; A24F 47/006; A24F 47/008; A24B 15/165
USPC ..... 131/270, 273, 194; 128/202.21
See application file for complete search history.

(56) References Cited

U.S. PATENT DOCUMENTS 2,976,190 A 3/1961 Meyer
3,165,105 A 1/1965 Campbell (Continued)

FOREIGN PATENT DOCUMENTS

EP 399252 A2 11/1990
EP 0472367 A1 2/1992

(Continued)

OTHER PUBLICATIONS

US 5,119,837, 06/1992, Banerjee et al. (withdrawn).
U.S. Appl. No. 11/377,630.
U.S. Appl. No. 12/688,598.
U.S. Appl. No. 12/775,130.
U.S. Appl. No. 12/775,278.
U.S. Appl. No. 12/859,494.

(Continued)

*Primary Examiner* — Michael H Wilson
*Assistant Examiner* — Yana B Krinker
(74) *Attorney, Agent, or Firm* — Brinks Gilson & Lione

(57) ABSTRACT

A cigarette includes lighting and mouth ends. It may include a smokable segment disposed at the lighting end. It also includes a mouth-end segment; an aerosol-generation system disposed between the lighting and mouth ends, which includes (i) a heat-generation segment adjacent the smokable segment, including a heat source and an insulation layer and (ii) an aerosol-generating segment including a substrate, which may include tobacco pellets and aerosol-forming material disposed in a substrate cavity between the heat generation segment and the mouth end; a piece of outer wrapping material that provides an overwrap around at least a portion of the aerosol-generating segment, the heat-generation segment, and at least a portion of the smokable segment and includes a foil strip laminated thereon; those segments being connected together by the overwrap to provide a cigarette rod; that is connected to the mouth-end segment using tipping material.

19 Claims, 6 Drawing Sheets

Related U.S. Application Data continuation-in-part of application No. 12/775,278, filed on May 6, 2010, now Pat. No. 8,424,538, and a continuation-in-part of application No. 12/859,494, filed on Aug. 19, 2010.

(51) Int. Cl.
*A24B 15/16* (2006.01)
*A24C 5/00* (2006.01)

(56) References Cited

U.S. PATENT DOCUMENTS

| | | | | |
|---|---|---|---|---|
| 3,308,600 | A | 3/1967 | Erdmann et al. | |
| 3,586,005 | A | 6/1971 | Lippman, Jr. et al. | |
| 3,709,706 | A | 1/1973 | Sowman | |
| 3,840,024 | A | 10/1974 | Nicholl | |
| 4,280,187 | A | 7/1981 | Reuland et al. | |
| 4,281,670 | A | 8/1981 | Heitmann et al. | |
| 4,572,216 | A | 2/1986 | Josuttis et al. | |
| 4,714,082 | A | 12/1987 | Banerjee et al. | |
| 4,756,318 | A | 7/1988 | Clearman et al. | |
| 4,807,809 | A | 2/1989 | Pryor et al. | |
| 4,850,301 | A | 7/1989 | Greene, Jr. et al. | |
| 4,881,556 | A | 11/1989 | Clearman et al. | |
| 4,893,637 | A | 1/1990 | Hancock et al. | |
| 4,922,901 | A | 5/1990 | Brooks et al. | |
| 4,938,238 | A | 7/1990 | Barnes et al. | |
| 4,981,522 | A * | 1/1991 | Nichols | A24B 15/165 131/194 |
| 4,989,619 | A | 2/1991 | Clearman et al. | |
| 5,020,548 | A | 6/1991 | Farrier et al. | |
| 5,025,814 | A | 6/1991 | Raker | |
| 5,027,836 | A | 7/1991 | Shannon et al. | |
| 5,027,837 | A * | 7/1991 | Clearman | A24F 47/004 131/194 |
| 5,040,551 | A | 8/1991 | Schlatter et al. | |
| 5,042,509 | A | 8/1991 | Banerjee et al. | |
| 5,065,776 | A | 11/1991 | Lawson et al. | |
| 5,067,499 | A | 11/1991 | Banerjee et al. | |
| 5,076,297 | A | 12/1991 | Farrier et al. | |
| 5,099,861 | A | 3/1992 | Clearman et al. | |
| 5,105,831 | A | 4/1992 | Banerjee et al. | |
| 5,105,837 | A | 4/1992 | Barnes et al. | |
| 5,105,838 | A | 4/1992 | White et al. | |
| 5,115,820 | A | 5/1992 | Hauser et al. | |
| 5,129,409 | A | 7/1992 | White et al. | |
| 5,137,034 | A | 8/1992 | Perfetti et al. | |
| 5,148,821 | A | 9/1992 | Best et al. | |
| 5,156,170 | A | 10/1992 | Clearman et al. | |
| 5,178,167 | A | 1/1993 | Riggs et al. | |
| 5,183,062 | A | 2/1993 | Clearman et al. | |
| 5,203,355 | A | 4/1993 | Clearman et al. | |
| 5,211,684 | A | 5/1993 | Shannon et al. | |
| 5,246,017 | A | 9/1993 | Saintsing et al. | |
| 5,247,947 | A | 9/1993 | Clearman et al. | |
| 5,285,798 | A | 2/1994 | Banerjee et al. | |
| 5,303,720 | A | 4/1994 | Banerjee et al. | |
| 5,345,955 | A | 9/1994 | Clearman et al. | |
| 5,396,911 | A | 3/1995 | Casey, III et al. | |
| 5,415,186 | A | 5/1995 | Casey, III et al. | |
| 5,469,871 | A | 11/1995 | Barnes et al. | |
| 5,546,965 | A | 8/1996 | White | |
| 5,551,451 | A | 9/1996 | Riggs et al. | |
| 5,560,376 | A | 10/1996 | Meiring et al. | |
| 5,588,446 | A | 12/1996 | Clearman | |
| 5,622,190 | A | 4/1997 | Arterbery et al. | |
| 5,692,525 | A | 12/1997 | Counts et al. | |
| 5,706,834 | A | 1/1998 | Meiring et al. | |
| 5,720,320 | A | 2/1998 | Evans | |
| 5,724,997 | A | 3/1998 | Smith et al. | |
| 5,727,571 | A | 3/1998 | Meiring et al. | |
| 5,791,384 | A | 8/1998 | Evans | |
| 5,819,751 | A | 10/1998 | Barnes et al. | |
| 5,902,431 | A | 5/1999 | Wilkinson et al. | |
| 5,944,025 | A | 8/1999 | Cook et al. | |
| 6,229,115 | B1 | 5/2001 | Voss et al. | |
| 6,849,085 | B2 | 2/2005 | Marton | |
| 7,290,549 | B2 | 11/2007 | Banerjee et al. | |
| 7,293,593 | B2 | 11/2007 | Schiebout | |
| 7,296,578 | B2 | 11/2007 | Read, Jr. | |
| 7,434,585 | B2 | 10/2008 | Holmes | |
| 7,479,098 | B2 | 1/2009 | Thomas et al. | |
| 7,503,330 | B2 | 3/2009 | Borschke et al. | |
| 7,647,932 | B2 | 1/2010 | Cantrell et al. | |
| 7,740,019 | B2 | 6/2010 | Nelson et al. | |
| 7,793,665 | B2 | 9/2010 | Dube et al. | |
| 7,836,897 | B2 | 11/2010 | Borschke et al. | |
| 7,972,254 | B2 | 7/2011 | Stokes et al. | |
| 2002/0119873 | A1 | 8/2002 | Heitmann | |
| 2004/0031495 | A1 | 2/2004 | Steinberg | |
| 2004/0173229 | A1 | 9/2004 | Crooks et al. | |
| 2005/0066986 | A1 | 3/2005 | Nestor et al. | |
| 2005/0274390 | A1 | 12/2005 | Banerjee et al. | |
| 2006/0112963 | A1 | 6/2006 | Scott et al. | |
| 2006/0169295 | A1 | 8/2006 | Draghetti | |
| 2006/0201524 | A1 | 9/2006 | Zhang et al. | |
| 2006/0231113 | A1 | 10/2006 | Newbery et al. | |
| 2006/0272663 | A1 | 12/2006 | Dube et al. | |
| 2007/0023056 | A1 | 2/2007 | Cantrell et al. | |
| 2007/0181141 | A1 | 8/2007 | Xue et al. | |
| 2007/0186945 | A1 | 8/2007 | Olegario et al. | |
| 2007/0215167 | A1* | 9/2007 | Llewellyn Crooks | A24F 47/006 131/335 |
| 2007/0215168 | A1 | 9/2007 | Banerjee et al. | |
| 2008/0029118 | A1 | 2/2008 | Nelson et al. | |
| 2008/0092912 | A1 | 4/2008 | Robinson et al. | |
| 2008/0142028 | A1 | 6/2008 | Fagg | |
| 2008/0233294 | A1 | 9/2008 | Lobovsky et al. | |
| 2008/0302373 | A1 | 12/2008 | Stokes et al. | |
| 2009/0044818 | A1 | 2/2009 | Takeuchi et al. | |
| 2009/0090372 | A1 | 4/2009 | Thomas et al. | |
| 2009/0090373 | A1 | 4/2009 | Borschke et al. | |
| 2009/0194118 | A1 | 8/2009 | Ademe et al. | |
| 2009/0288667 | A1 | 11/2009 | Andresen et al. | |
| 2009/0288672 | A1 | 11/2009 | Hutchens | |
| 2010/0065075 | A1 | 3/2010 | Banerjee et al. | |
| 2010/0186757 | A1 | 7/2010 | Crooks et al. | |
| 2010/0200006 | A1 | 8/2010 | Robinson et al. | |
| 2011/0041861 | A1 | 2/2011 | Sebastian et al. | |
| 2011/0180082 | A1 | 7/2011 | Banerjee et al. | |
| 2011/0271971 | A1 | 11/2011 | Conner et al. | |
| 2011/0271972 | A1 | 11/2011 | Thomas et al. | |
| 2012/0042885 | A1 | 2/2012 | Stone et al. | |

FOREIGN PATENT DOCUMENTS

| | | | |
|---|---|---|---|
| EP | 532194 | A1 | 3/1993 |
| EP | 1226765 | A2 | 7/2002 |
| EP | 1559332 | A1 | 8/2005 |
| EP | 2100840 | A1 | 9/2009 |
| EP | 2113177 | A1 | 11/2009 |
| WO | WO 2008/015441 | A1 | 2/2008 |
| WO | WO 2009/112257 | A1 | 9/2009 |
| WO | WO 2009/132828 | A1 | 11/2009 |
| WO | WO 2011/028372 | A1 | 3/2011 |
| WO | WO 2011/045066 | A1 | 4/2011 |
| WO | WO 2011/139730 | A1 | 11/2011 |

OTHER PUBLICATIONS

International Search Report for International Application No. PCT/US2010/044989, dated Jan. 21, 2011, 3 pages.
Written Opinion of the International Searching Authority for International Application No. PCT/US2010/044989, dated Jan. 21, 2011, 6 pages.
International Search Report for International Application No. PCT/US2011/034040, dated Oct. 19, 2011, 3 pages.
International Search Report and Written Opinion for Int'l Application No. PCT/US2012/051850, date of mailing Jun. 11, 2013.

* cited by examiner

SEGMENTED SMOKING ARTICLE WITH SUBSTRATE CAVITY

CROSS-REFERENCE TO RELATED APPLICATIONS

This application is a continuation of, and claims priority under 35 U.S.C. §120 to co-pending U.S. patent application Ser. No. 13/236,962, filed Sep. 20, 2011, which is a continuation-in-part of U.S. patent application Ser. No. 12/775,130, filed May 6, 2010; Ser. No. 12/775,278, filed May 6, 2010; and Ser. No. 12/859,494, filed Aug. 19, 2010, each of which is incorporated herein by reference in its entirety.

TECHNICAL FIELD

The present invention relates to products made or derived from tobacco, or that otherwise incorporate tobacco, and are intended for human consumption. The present application relates particularly to components and configurations of segmented-type smoking articles.

BACKGROUND

Popular smoking articles, such as cigarettes, have a substantially cylindrical rod-shaped structure and include a charge, roll or column of smokable material, such as shredded tobacco (e.g., in cut filler form), surrounded by a paper wrapper, thereby forming a so-called "smokable rod", "tobacco rod" or "cigarette rod." Normally, a cigarette has a cylindrical filter element aligned in an end-to-end relationship with the tobacco rod. Preferably, a filter element comprises plasticized cellulose acetate tow circumscribed by a paper material known as "plug wrap." Preferably, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth in Tobacco Production, Chemistry and Technology, Davis et al. (Eds.) (1999) and U.S. Pat. No. 7,503,330 to Borschke et al, which is incorporated herein by reference. A cigarette is employed by a smoker by lighting one end thereof and burning the tobacco rod. The smoker then receives mainstream smoke into his/her mouth by drawing on the opposite end (e.g., the filter end) of the cigarette.

Certain types of cigarettes that employ carbonaceous fuel elements have been commercially marketed under the brand names "Premier" and "Eclipse" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000). More recently, a cigarette has been marketed in Japan by Japan Tobacco Inc. under the brand name "Steam Hot One." It has also been suggested that the carbonaceous fuel elements of segmented types of cigarettes may incorporate ultrafine particles of metals and metal oxides. See, for example, U.S. Pat. App. Pub. No. 2005/0274390 to Banerjee et al., which is incorporated by reference herein in its entirety.

Yet other types of smoking articles, such as those types of smoking articles that generate flavored vapors by subjecting tobacco or processed tobaccos to heat produced from chemical or electrical heat sources are described in U.S. Pat. No. 5,285,798 to Banerjee et al. and U.S. Pat. No. 7,290,549 to Banerjee et al., and U.S. Pat. App. Pub. No. 2008/0092912 to Robinson et al., which are incorporated by reference herein in their entirety. One type of smoking article that has employed electrical energy to produce heat has been commercially marketed by Philip Morris Inc. under the brand name "Accord."

Smoking articles that employ sources of heat other than tobacco cut filler to produce tobacco-flavored vapors or tobacco-flavored visible aerosols have not received widespread commercial success. However, it would be highly desirable to provide smoking articles that demonstrate the ability to provide to a smoker many of the benefits and advantages of conventional cigarette smoking, without delivering considerable quantities of incomplete combustion and pyrolysis products.

SUMMARY

Embodiments of the present invention relate to smoking articles, and in particular, to rod-shaped smoking articles, such as cigarettes. A smoking article includes a lighting end (i.e., an upstream end) and a mouth end (i.e., a downstream end). The smoking article also includes an aerosol-generation system that includes (i) a heat generation segment, and (ii) an aerosol-generating region or segment located downstream from the heat generation segment. The aerosol-generating segment may include a substrate including pellets or beads of marumarized or non-marumarized tobacco disposed within a substrate cavity. The substrate cavity may be circumscribed by a foil strip laminated to a wrapping material.

Further features and advantages of the present invention are set forth in more detail in the following description.

BRIEF DESCRIPTION OF THE DRAWINGS

Embodiments may better be understood with reference to the following drawings, which are illustrative only and are not limiting.

DETAILED DESCRIPTION OF THE PREFERRED EMBODIMENTS

Aspects and embodiments of the present invention relating to various smoking articles, the arrangement of various components thereof, and the manner that those smoking articles incorporate overwrap components, are illustrated with reference to FIGS. 1 and 2. Like components are given like numeric designations throughout the figures. For the various figures, the thicknesses of the various wrapping materials and overwraps of the various smoking articles and smoking article components are exaggerated. Most preferably, wrapping materials and overwrap components are tightly wrapped around the smoking articles and smoking article components to provide a tight fit, and provide an aesthetically pleasing appearance. Exemplary smoking article construction may include features such as fibrous filter elements, foamed ceramic monoliths formed as insulators or fuel elements, and other features disclosed in U.S. Pat. App. Pub. No. 2011/0041861 to Sebastian et al., which is incorporated herein by reference in its entirety.

Figure 1:
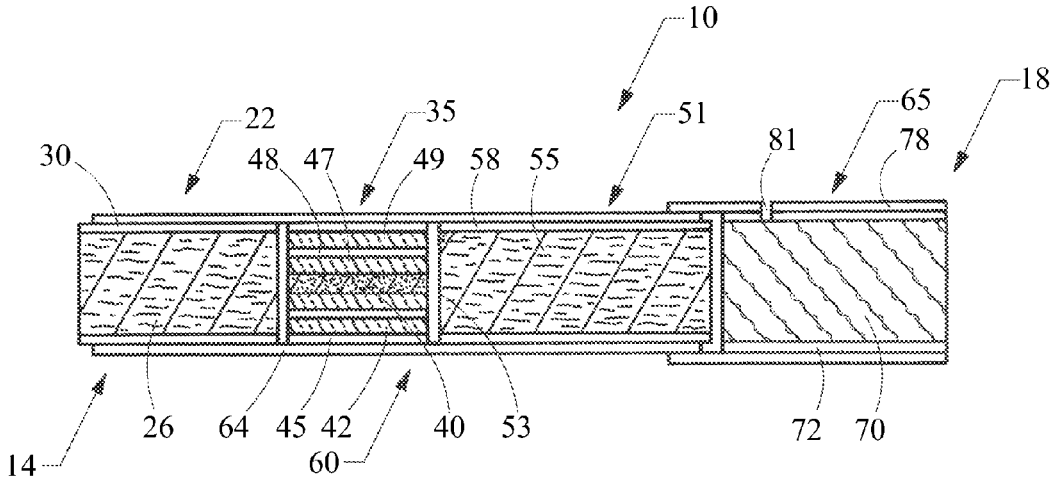
FIGS. 1-2 provide longitudinal cross-sectional views of representative smoking articles.

Referring to FIG. 1, a representative smoking article 10 in the form of a cigarette is shown. The smoking article 10 has a rod-like shape, and includes a lighting end 14 and a mouth end 18.

At the lighting end 14 is positioned a longitudinally extending, generally cylindrical smokable lighting end segment 22, incorporating smokable material 26. A representative smokable material 26 can be a plant-derived material (e.g., tobacco material in cut filler form). An exemplary cylindrical smokable lighting end segment 22 includes a charge or roll of the smokable material 26 (e.g., tobacco cut filler) wrapped or disposed within, and circumscribed by, a paper wrapping material 30. As such, the longitudinally extending outer surface of that cylindrical smokable lighting end segment 22 is provided by the wrapping material 30. Preferably, both ends of the segment 22 are open to expose the smokable material 26. The smokable lighting end segment 22 can be configured so that smokable material 26 and wrapping material 30 each extend along the entire length thereof.

Located downstream from the smokable lighting end segment 22 is a longitudinally extending, generally cylindrical heat generation segment 35. The heat generation segment 35 includes a heat source 40 circumscribed by insulation 42, which may be coaxially encircled by wrapping material 45. The heat source 40 preferably is configured to be activated by combustion of the smokable material 26. Ignition and combustion of the smoking material preferably provide a user with a desirable experience (with respect at least to flavor and time taken to light the smoking article 10). The heat generated as the smokable material is consumed most preferably is sufficient to ignite or otherwise activate the heat source 40.

Figure 3:
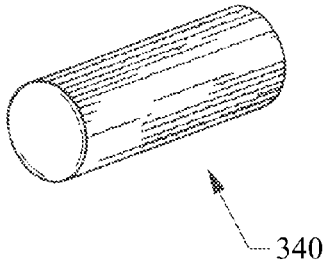
FIG. 3 shows a representative fuel element.

The heat source 40 may include a combustible fuel element that has a generally cylindrical shape and can incorporate a combustible carbonaceous material. Carbonaceous materials generally have high carbon contents. Preferred carbonaceous materials are composed predominately of carbon, typically have carbon contents of greater than about 60 percent, generally greater than about 70 percent, often greater than about 80 percent, and frequently greater than about 90 percent, on a dry weight basis. Fuel elements can incorporate components other than combustible carbonaceous materials (e.g., tobacco components, such as powdered tobaccos or tobacco extracts; flavoring agents; salts, such as sodium chloride, potassium chloride and sodium carbonate; heat stable graphite fibers; iron oxide powder; glass filaments; powdered calcium carbonate; alumina granules; ammonia sources, such as ammonia salts; and/or binding agents, such as guar gum, ammonium alginate and sodium alginate). A representative fuel element has a length of about 12 mm and an overall outside diameter of about 4.2 mm. A representative fuel element can be extruded or compounded using a ground or powdered carbonaceous material, and has a density that is greater than about 0.5 g/cm$^3$, often greater than about 0.7 g/cm$^3$, and frequently greater than about 1 g/cm$^3$, on a dry weight basis. See, for example, the types of fuel element components, formulations and designs set forth in U.S. Pat. No. 5,551,451 to Riggs et al. and U.S. Pat. No. 7,836,897 to Borschke et al., which are incorporated herein by reference in their entirety. Particular embodiments of fuel elements are described below with reference to FIG. 3.

Another embodiment of a fuel element 40 may include a foamed carbon monolith formed in a foam process. In another embodiment, the fuel element 40 may be co-extruded with a layer of insulation 42, thereby reducing manufacturing time and expense. Still other embodiments of fuel elements may include those of the types described in U.S. Pat. No. 4,922,901 to Brooks et al. or U.S. Pat. App. Pub. No. 2009/0044818 to Takeuchi et al., each of which is incorporated herein by reference.

A representative layer of insulation 42 can comprise glass filaments or fibers. The insulation 42 can act as a jacket that assists in maintaining the heat source 40 firmly in place within the smoking article 10. The insulation 42 can be provided as a multi-layer component including an inner layer or mat 47 of non-woven glass filaments, an intermediate layer of reconstituted tobacco paper 48, and an outer layer of non-woven glass filaments 49. These may be concentrically oriented or each overwrapping and/or circumscribing the heat source.

In one embodiment, the inner layer 47 of insulation may include a variety of glass or non-glass filaments or fibers that are woven, knit, or both woven and knit (such as, for example, so-called 3-D woven/knit hybrid mats). When woven, an inner layer 47 may be formed as a woven mat or tube. A woven or knitted mat or tube can provide superior control of air flow with regard to evenness across the insulation layer (including as any thermal-related changes may occur to the layer). Those of skill in the art will appreciate that a woven, knit, or hybrid material may provide more regular and consistent air spaces/gaps between the filaments or fibers as compared to a non-woven material which is more likely to have irregularly closed and open spaces that may provide comparatively non-uniform and/or decreased air-flow. Various other insulation embodiments may be molded, extruded, foamed, or otherwise formed. Particular embodiments of insulation structures may include those described in U.S. Pat. App. Publ. No. 20120042885 to Stone et al., which is incorporated by reference herein in its entirety.

Preferably, both ends of the heat generation segment 35 are open to expose the heat source 40 and insulation 42 to the adjacent segments. The heat source 40 and the surrounding insulation 42 can be configured so that the length of both materials is co-extensive (i.e., the ends of the insulation 42 are flush with the respective ends of the heat source 40, and particularly at the downstream end of the heat generation segment). Optionally, though not necessarily preferably, the insulation 42 may extend slightly beyond (e.g., from about 0.5 mm to about 2 mm beyond) either or both ends of the heat source 40. Moreover, smoke produced when the smokable lighting end segment 22 is burned during use of the smoking article 10 can readily pass through the heat generation segment 35 during draw by the smoker on the mouth end 18.

The heat generation segment 35 preferably is positioned adjacent to the downstream end of the smokable lighting end segment 22 such that those segments are axially aligned in an end-to-end relationship, preferably abutting one another, but with no barrier (other than open air-space) therebetween. The close proximity of the heat generation segment 35 and the smokable lighting end segment 22 provides for an appropriate heat exchange relationship (e.g., such that the action of burning smokable material within the smokable lighting end segment 22 acts to ignite the heat source of the heat generation segment 35). The outer cross-sectional shapes and dimensions of the smokable lighting end and heat generation segments 22, 35, when viewed transversely to the longitudinal axis of the smoking article, can be essentially identical to one another (e.g., both appear to have a cylindrical shape, each having essentially identical diameters).

The cross-sectional shape and dimensions of the heat generation segment 35, prior to burning, can vary. Preferably, the cross-sectional area of the heat source 40 makes up about 10 percent to about 35 percent, often about 15 percent to about 25 percent of the total cross-sectional area of that segment 35; while the cross-sectional area of the outer or circumscribing region (comprising the insulation 42 and relevant outer wrapping materials) makes up about 65 percent to about 90 percent, often about 75 percent to about 85 percent of the total cross-sectional area of that segment 35. For example, for a cylindrical smoking article having a circumference of about 24 mm to about 26 mm, a representative heat source 40 has a generally circular cross-sectional shape with an outer diameter of about 2.5 mm to about 5 mm, often about 3 mm to about 4.5 mm.

A longitudinally extending, cylindrical aerosol-generating segment 51 is located downstream from the heat generation segment 35. The aerosol-generating segment 51 includes a substrate material 55 that, in turn, acts as a carrier for an aerosol-forming agent or material (not shown). For example, the aerosol-generating segment 51 can include a reconstituted tobacco material that includes processing aids, flavoring agents, and glycerin.

The foregoing components of the aerosol-generating segment 51 can be disposed within, and circumscribed by, a wrapping material 58. The wrapping material 58 can be configured to facilitate the transfer of heat from the lighting end 14 of the smoking article 10 (e.g., from the heat generation segment 35) to components of the aerosol-generating segment 51. That is, the aerosol-generating segment 51 and the heat generation segment 35 can be configured in a heat exchange relationship with one another. The heat exchange relationship is such that sufficient heat from the heat source 40 is supplied to the aerosol-formation region to volatilize aerosol-forming material for aerosol formation. In some embodiments, the heat exchange relationship is achieved by positioning those segments in close proximity to one another. A heat exchange relationship also can be achieved by extending a heat conductive material from the vicinity of the heat source 40 into or around the region occupied by the aerosol-generating segment 51. Particular embodiments of substrates may include those described below or those described in U.S. Pat. App. Pub. No. 2012/0042885 to Stone et al., which is incorporated by reference herein in its entirety.

A representative wrapping material 58 for the substrate material 55 may include heat conductive properties to conduct heat from the heat generation segment 35 to the aerosol-generating segment 51, in order to provide for the volatilization of the aerosol forming components contained therein. The substrate material 55 may be about 10 mm to about 22 mm in length, with certain embodiments being about 11 mm to about 12 mm in length, and other embodiments ranging up to about 21 mm.

The substrate material 55 can be provided from a blend of flavorful and aromatic tobaccos in cut filler form. Those tobaccos, in turn, can be treated with aerosol-forming material and/or at least one flavoring agent. The substrate material can be provided from a processed tobacco (e.g., a reconstituted tobacco manufactured using cast sheet or papermaking types of processes) in cut filler form. Certain cast sheet constructions may include about 270 to about 300 mg of tobacco per 10 mm of linear length. That tobacco, in turn, can be treated with, or processed to incorporate, aerosol-forming material and/or at least one flavoring agent, as well as a burn retardant (e.g., diammonium phosphate or another salt) configured to help prevent ignition and/or scorching by the heat-generation segment. A metal inner surface of the wrapping material 58 of the aerosol-generating segment 51 can act as a carrier for aerosol-forming material and/or at least one flavoring agent.

In other embodiments, the substrate 55 may include a tobacco paper or non-tobacco gathered paper formed as a plug section. The plug section may be loaded with aerosol-forming materials, flavorants, tobacco extracts, or the like in a variety of forms (e.g., microencapsulated, liquid, powdered). A burn retardant (e.g., diammonium phosphate or another salt) may be applied to at least a distal/lighting-end portion of the substrate to help prevent ignition and/or scorching by the heat-generation segment.

In these and/or other embodiments, the substrate 55 may include pellets or beads formed from marumarized and/or non-marumarized tobacco. Marumarized tobacco is known, for example, from U.S. Pat. No. 5,105,831 to Banerjee, et al., which is incorporated herein by reference. Marumarized tobacco may include about 20 to about 50 percent (by weight) tobacco blend in powder form, with glycerol (at about 20 to about 30 percent by weight), calcium carbonate (generally at about 10 to about 60 percent by weight, often at about 40 to about 60 percent by weight), along with binder and flavoring agents. The binder may include, for example, a carboxymethyl cellulose (CMC), gums (e.g., guar gum), xanthan, pullulan, or alginates. The beads, pellets, or other marumarized forms may be constructed in dimensions appropriate to fitting within a substrate section and providing for optimal air flow and production of desirable aerosol. A container, such as a cavity or capsule, may be formed for retaining the substrate in place within the smoking article. Such a container may be beneficial to contain, for example, pellets or beads of marumarized and/or non-marumarized tobacco. The container may be formed using wrapping materials as further described below. The term "tobacco pellets" is defined herein to include beads, pellets, or other discrete small units of tobacco that may include marumarized and/or non-marumarized tobacco. The tobacco pellets may have smooth, regular outer shapes (e.g., spheres, cylinders, ovoids, etc.) and/or they may have irregular outer shapes. In one example, the diameter of each tobacco pellet may range from less than about 1 mm to about 2 mm. The tobacco pellets may at least partially fill a substrate cavity of a smoking article as described herein. In one example, the volume of the substrate cavity may range from about 500 $mm^3$ to about 700 $mm^3$ (e.g., a substrate cavity of a smoking article where the cavity diameter is about 7.5 to about 7.8 mm, and the cavity length is about 11 to about 15 mm, with the cavity having a generally cylindrical geometry). In one example, the mass of the tobacco pellets within the substrate cavity may range from about 200 mg to about 500 mg.

In still other embodiments, the substrate 55 may be configured as a monolithic substrate. The monolithic substrate may be formed as described in U.S. Pat. App. Publ.

No. 2012/0042885 to Stone et al., which is incorporated herein by reference in its entirety. The substrate may include or be constructed from an extruded material. The substrate also may be formed by press-fit or molding/casting. Thus, the generic term "monolithic substrate" may include a substrate formed by extrusion or by one of those other methods.

For preferred smoking articles, both ends of the aerosol-generating segment 51 are open to expose the substrate material 55 thereof. Components of the aerosol produced by burning the smokable lighting end segment 22 during use of the smoking article can readily pass through the aerosol-generating segment 51 during draw on the mouth end 18.

Together, the heat generating segment 35 and the aerosol-generating segment 51 form an aerosol-generation system 60. The aerosol-generating segment 51 is positioned adjacent to the downstream end of the heat generation segment 35 such that those segments 51, 35 are axially aligned in an end-to-end relationship. Those segments can abut one another, or be positioned in a slightly spaced apart relationship, which may include a buffer region 53. The outer cross-sectional shapes and dimensions of those segments, when viewed transversely to the longitudinal axis of the smoking article 10, can be essentially identical to one another. The physical arrangement of those components preferably is such that heat is transferred (e.g., by means that includes conductive and convective heat transfer) from the heat source 40 to the adjacent substrate material 55, throughout the time that the heat source is activated (e.g., burned) during use of the smoking article 10.

A buffer region 53 may reduce potential scorching or other thermal degradation of portions of the aerosol-generating segment 51. The buffer region 53 may mainly include empty air space, or it may be partially or substantially completely filled with a non-combustible material such as, for example, metal, organic, inorganic, ceramic, or polymeric materials, or any combination thereof. The buffer regions may be from about 1 mm to about 10 mm or more in thickness, but often will be about 2 mm to about 5 mm in thickness.

The components of the aerosol-generation system 60 and the smokable lighting end segment 22 preferably are attached to one another, and secured in place using an overwrap material 64. For example, the overwrap material 64 can include a paper wrapping material or a laminated paper-type material that circumscribes each of the heat generation segment 35, at least a portion of outer longitudinally extending surface of the aerosol-generating segment 51, and at least a portion of the lighting end segment 22 that is adjacent to the heat generation segment. The inner surface of the overwrap material 64 may be secured to the outer surfaces of the components it circumscribes by a suitable adhesive. Preferably, the overwrap material 64 extends over a significant portion of the length of the smokable lighting end segment 22.

The smoking article 10 preferably includes a suitable mouthpiece such as, for example, a filter element 65, positioned at the mouth end 18 thereof. The filter element 65 preferably is positioned at one end of the cigarette rod adjacent to one end of the aerosol-generating segment 51, such that the filter element 65 and the aerosol-generating segment 51 are axially aligned in an end-to-end relationship, abutting one another but without any barrier therebetween. Preferably, the general cross-sectional shapes and dimensions of those segments 51, 65 are essentially identical to one another when viewed transversely to the longitudinal axis of the smoking article. The filter element 65 may include filter material 70 that is overwrapped along the longitudinally extending surface thereof with circumscribing plug wrap material 72. In one example, the filter material 70 includes plasticized cellulose acetate tow, while in some examples the filter material may further include activated charcoal in an amount from about 20 to about 80 mg disposed as a discrete charge or dispersed throughout the acetate tow in a "Dalmatian type" filter. Both ends of the filter element 65 preferably are open to permit the passage of aerosol therethrough. The aerosol-generating system 60 preferably is attached to the filter element 65 using tipping material 78. The filter element 65 may also include a crushable flavor capsule of the type described in U.S. Pat. No. 7,479,098 to Thomas et al. and U.S. Pat. No. 7,793,665 to Dube et al.; and U.S. Pat. App. Pub. No. 2009/0194118 to Ademe et al., which are incorporated herein by reference in their entirety.

The smoking article 10 may include an air dilution means, such as a series of perforations 81, each of which may extend through the filter element tipping material 78 and plug wrap material 72 in the manner shown, and/or which may extend to or into the substrate 55.

The overall dimensions of the smoking article 10, prior to burning, can vary. Typically, smoking articles 10 are cylindrically shaped rods having circumferences of about 20 mm to about 27 mm, have overall lengths of about 70 mm to about 130 mm—often about 83 mm to about 100 mm. Smokable lighting end segments 22 typically have lengths of about 3 mm to about 15 mm, but can be up to about 30 mm. The aerosol-generation system 60 has an overall length that can vary from about 20 mm to about 65 mm. The heat generation segment 35 of the aerosol-generation system 60 may have a length of about 5 mm to about 30 mm; and the aerosol-generating segment 51 of the aerosol-generation system 60 may have an overall length of about 10 mm to about 60 mm.

The amount of smokable material 26 employed to manufacture the smokable lighting end segment 22 can vary. Typically, the smokable lighting end segment 22, manufactured predominantly from tobacco cut filler, includes at least about 20 mg, generally at least about 50 mg, often at least about 75 mg, and frequently at least 100 mg, of tobacco material, on a dry weight basis. The packing density of the smokable material 26 within the smokable lighting end segment 22 preferably will be less than the density of the fuel element (e.g., about 100 to about 400 mg/cm$^3$). Preferably, the smokable lighting end segment 22 essentially comprises smokable material 26, and does not include a carbonaceous fuel element component.

The combined amount of aerosol-forming agent and substrate material 55 employed in the aerosol-generating segment 51 can vary. The material preferably may be employed so as to fill the appropriate section of the aerosol-generating segment 51 (e.g., the region within the wrapping material 58 thereof) at a packing density of about 100 to about 400 mg/cm$^3$.

During use, the smoker lights the lighting end 14 of the smoking article 10 using a match or cigarette lighter, in a manner similar to the way that conventional smoking articles are lit. As such, the smokable material 26 of the smokable lighting end segment 22 begins to burn. The mouth end 18 of the smoking article 10 is placed in the lips of the smoker. Thermal decomposition products (e.g., components of tobacco smoke) generated by the burning smokable material 26 are drawn through the smoking article 10, through the filter element 65, and into the mouth of the smoker. That is, when smoked, the smoking article yields visible mainstream aerosol that resembles the mainstream tobacco smoke of traditional cigarettes that burn tobacco cut filler.

Burning the smokable lighting end segment 22 heats the fuel element 40 of the heat generation segment 35 such that it preferably will be ignited or otherwise activated (e.g., begin to burn). The heat source 40 within the aerosol-generation system 60 will burn, and provide heat to volatilize aerosol-forming material within the aerosol-generating segment 51 as a result of the heat exchange relationship between those two segments. Certain preferred heat sources 40 will not experience volumetric decrease during activation, while others may degrade in a manner that reduces their volume. Preferably, the components of the aerosol-generating segment 51 do not experience thermal decomposition (e.g., charring or burning) to any significant degree. Volatilized components are entrained in the air that is drawn through the aerosol-generating region 51. The aerosol so formed will be drawn through the filter element 65, and into the mouth of the smoker.

During certain periods of use, aerosol formed within the aerosol-generating segment 51, along with the aerosol (i.e., smoke) formed as a result of the thermal degradation of the smokable material 26 within the smokable lighting end segment 22, will be drawn through the filter element 65 and into the mouth of the smoker. Thus, the mainstream aerosol produced by the smoking article 10 includes tobacco smoke produced by the thermal decomposition of the tobacco cut filler as well as by the volatilized aerosol-forming material. For early puffs (i.e., during and shortly after lighting), most of the mainstream aerosol results from thermal decomposition of the smokable lighting end segment 22. For later puffs (i.e., after the smokable lighting end segment 22 has been consumed and the heat source 40 of the aerosol-generation system 60 has been ignited), most of the mainstream aerosol that is provided will be produced by the aerosol-generation system 60. When the smokable material 26 has been consumed, and the heat source 40 extinguishes, the use of the smoking article is ceased (i.e., the smoking experience is finished).

Figure 2:
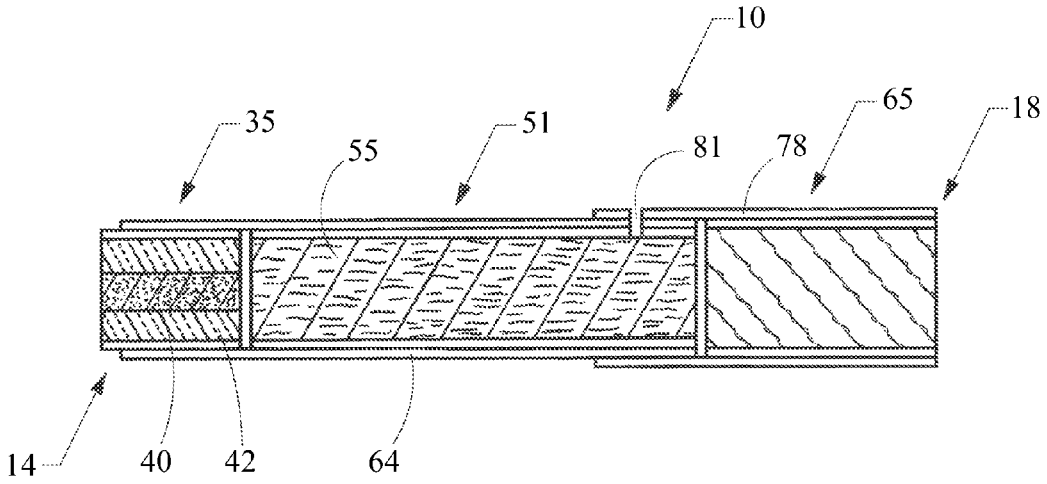

Referring to FIG. 2, a representative smoking article 10 in the form of a cigarette is shown. The smoking article 10 includes a heat generation segment 35 located at the lighting end 14, a filter segment 65 located at the other end (mouth end 18), and an aerosol-generating segment 51 (which may incorporate tobacco) that is located in between those two segments near the lighting end. The heat generation segment 35 of FIG. 2 can incorporate a generally cylindrical carbonaceous heat source circumscribed by insulation similar to what is shown in FIG. 1. The composition and dimensions of the various segments of the smoking article 10 in FIG. 2 are generally similar in manner with respect to those set forth previously with reference to FIG. 1, but without a charge of smokable material at the distal/lighting end, such that the fuel element is ignited directly rather than by a smokable material that was ignited and burned.

A filter element 65 preferably is attached to the cigarette rod so formed using a tipping material 78, in the general manner set forth previously with reference to FIG. 1. The smoking article optionally can be air-diluted by providing appropriate perforations 81 in the vicinity of the mouth end region 18, as is known in the art. Filters may include materials and may be manufactured by methods such as, for example, those disclosed in U.S. Pat. No. 7,740,019 to Nelson et al. and U.S. Pat. No. 7,972,254 to Stokes et al.; and U.S. Pat. Publ. Nos. 2008/0142028 to Fagg, et al.; 2009/0288672 to Hutchens et al.; and 2009/0090372 to Thomas et al., each of which is incorporated herein by reference.

Flavor may be provided or enhanced by capsule or microcapsule materials on or within the substrate material 55 of the aerosol-generating segment 51 (FIG. 1 may be considered to have microcapsules present therein for illustrative purposes), the wrapping materials, the filter element 65, or any other component capable of holding and releasing flavorants, preferably with minimal thermal degradation that would undesirably alter the flavor. Other flavor components associated with a filter may also be used; see, for example, U.S. Pat. No. 5,724,997 to Fagg, et al.

Cigarettes described with reference to FIG. 2 may be used in much the same manner as those cigarettes commercially marketed under the trade name "Eclipse" by R. J. Reynolds Tobacco Company. See also the "Steam Hot One" cigarette marketed by Japan Tobacco Inc.

Smokable materials of the smokable lighting end segment most preferably incorporate tobacco of some form. Preferred smokable materials are composed predominantly of tobacco, based on the dry weights of those materials. That is, the majority of the dry weight of those materials, and the majority of the weight of a mixture incorporating those materials (including a blend of materials, or materials having additives applied thereto or otherwise incorporated therein) are provided by tobacco of some form. Those materials may be made all of tobacco material, and not incorporate any non-tobacco fillers, substitutes or extenders. The smokable material can be treated with tobacco additives that are traditionally used for the manufacture of cigarettes, such as casing and/or top dressing components. These tobacco components may be understood with reference to the examples and references set forth in U.S. Pat. App. Pub. No. 2007/0215167 to Crooks, et al., which is incorporated herein by reference in its entirety.

Fuel elements of the heat generation segment may vary. Suitable fuel elements, and representative components, designs and configurations thereof, and manners and methods for producing those fuel elements and the components thereof, are set forth in U.S. Pat. No. 4,714,082 to Banerjee et al.; U.S. Pat. No. 4,756,318 to Clearman et al.; U.S. Pat. No. 4,881,556 to Clearman et al.; U.S. Pat. No. 4,989,619 to Clearman et al.; U.S. Pat. No. 5,020,548 to Farrier et al.; U.S. Pat. No. 5,027,837 to Clearman et al.; U.S. Pat. No. 5,067,499 to Banerjee et al.; U.S. Pat. No. 5,076,297 to Farrier et al.; U.S. Pat. No. 5,099,861 to Clearman et al.; U.S. Pat. No. 5,105,831 to Banerjee et al.; U.S. Pat. No. 5,129,409 to White et al.; U.S. Pat. No. 5,148,821 to Best et al.; U.S. Pat. No. 5,156,170 to Clearman et al.; U.S. Pat. No. 5,178,167 to Riggs et al.; U.S. Pat. No. 5,211,684 to Shannon et al.; U.S. Pat. No. 5,247,947 to Clearman et al.; U.S. Pat. No. 5,345,955 to Clearman et al.; U.S. Pat. No. 5,469,871 to Barnes et al.; U.S. Pat. No. 5,551,451 to Riggs; U.S. Pat. No. 5,560,376 to Meiring et al.; U.S. Pat. No. 5,706,834 to Meiring et al.; and U.S. Pat. No. 5,727,571 to Meiring et al.; and U.S. Pat. App. Pub. Nos. 2005/0274390 and 2010/0065075 to Banerjee et al.; which are incorporated herein by reference.

Fuel elements often comprise carbonaceous material and may include ingredients such as graphite or alumina, as well as high carbon content carbonaceous material. Carbonaceous fuel elements include the type that have been incorporated within those cigarettes commercially marketed under the trade names "Premier" and "Eclipse" by R. J. Reynolds Tobacco Company. See also the "Steam Hot One" cigarette marketed by Japan Tobacco Inc. Some other embodiments of fuel elements are set forth in U.S. Pat. No.

5,178,167 to Riggs et al. and U.S. Pat. No. 5,551,451 to Riggs et al., both which are incorporated herein by reference in their entirety, but certain embodiments may lack the sodium, graphite, and/or calcium carbonate set forth therein. Some fuel element embodiments may include a foamed carbon monolith. In another embodiment, the fuel element 40 may be co-extruded with a layer of insulation 42, thereby reducing manufacturing time and expense.

Fuel elements may be treated (e.g., dip-coated) with various precursors (e.g., a metal nitrate or metal oxide) and/or subjected to heat treatment. Such treatment may provide a reduced CO concentration in mainstream aerosol generated by a smoking article including a treated fuel element as compared to a smoking article including an untreated fuel element. Such fuel elements are further described in U.S. Pat. App. Publ. 2012/0042885, which is incorporated herein by reference in its entirety.

The fuel element preferably will be circumscribed or otherwise jacketed by insulation, or other suitable material. The insulation can be configured and employed so as to support, maintain and retain the fuel element in place within the smoking article. The insulation may additionally be configured such that drawn air and aerosol can pass readily therethrough. Examples of insulation materials, components of insulation assemblies, configurations of representative insulation assemblies within heat generation segments, wrapping materials for insulation assemblies, and manners and methods for producing those components and assemblies, are set forth in U.S. Pat. No. 4,807,809 to Pryor et al.; U.S. Pat. No. 4,893,637 to Hancock et al.; U.S. Pat. No. 4,938,238 to Barnes et al.; U.S. Pat. No. 5,027,836 to Shannon et al.; U.S. Pat. No. 5,065,776 to Lawson et al.; U.S. Pat. No. 5,105,838 to White et al.; U.S. Pat. No. 5,119,837 to Banerjee et al.; U.S. Pat. No. 5,247,947 to Clearman et al.; U.S. Pat. No. 5,303,720 to Banerjee et al.; U.S. Pat. No. 5,345,955 to Clearman et al.; U.S. Pat. No. 5,396,911 to Casey, I I I et al.; U.S. Pat. No. 5,546,965 to White; U.S. Pat. No. 5,727,571 to Meiring et al.; U.S. Pat. No. 5,902,431 to Wilkinson et al.; and U.S. Pat. No. 5,944,025 to Cook et al.; and U.S. Pat. App. Pub. No. 2011/0041861 to Sebastian et al.; which are incorporated herein by reference. Insulation assemblies have been incorporated within the types of cigarettes commercially marketed under the trade names "Premier" and "Eclipse" by R. J. Reynolds Tobacco Company, and as "Steam Hot One" cigarette marketed by Japan Tobacco Inc.

Flame/burn retardant materials and additives useful in insulation may include silica, carbon, ceramic, metallic fibers and/or particles. When treating cellulosic or other fibers such as—for example—cotton, boric acid or various organophosphate compounds may provide desirable flame-retardant properties. In addition, various organic or metallic nanoparticles may confer a desired property of flame-retardancy, as may diammonium phosphate and/or other salts. Other useful materials may include organo-phosphorus compounds, borax, hydrated alumina, graphite, potassium tripolyphosphate, dipentaerythritol, pentaerythritol, and polyols. Others such as nitrogenous phosphonic acid salts, mono-ammonium phosphate, ammonium polyphosphate, ammonium bromide, ammonium chloride, ammonium borate, ethanolammonium borate, ammonium sulphamate, halogenated organic compounds, thio-urea, and antimony oxides may be used but are not preferred agents. In each embodiment of flame-retardant, burn-retardant, and/or scorch-retardant materials used in insulation, substrate material and other components (whether alone or in any combination with each other and/or other materials), the desirable properties most preferably are provided without undesirable off-gassing or melting-type behavior.

An insulation fabric preferably will have sufficient oxygen diffusion capability to sustain a smoking article such as a cigarette lit during a desired usage time. Accordingly the insulation fabric preferably will be porous by virtue of its construction. In knit, woven, or combined woven and knit constructions, the required porosity may be controlled by configuring the assembly machinery to leave sufficient (desirably sized) gaps between fibers to allow for oxygen diffusion into the heat source. For non-woven fabrics, which may not be porous enough to promote evenly sustained combustion, additional porosity may be achieved by perforations into the insulation by methods known in the art including, for example, hot or cold pin perforation, flame perforation, embossing, laser cutting, drilling, blade cutting, chemical perforation, punching, and other methods. Each of the buffer and the insulation may include non-glass material that is woven, knit, or a combination thereof, a foamed metal material, a foamed ceramic material, a foamed ceramic metal composite, and any combination thereof, and the material in the insulation may be the same as or different than that in the buffer.

The aerosol-forming material can vary, and mixtures of various aerosol-forming materials can be used, as can various combinations and varieties of flavoring agents (including various materials that alter the sensory and/or organoleptic character or nature of mainstream aerosol of a smoking article), wrapping materials, mouth-end pieces, filter elements, plug wrap, and tipping material. Representative types of these components are set forth in U.S. Pat. App. Pub. No. 2007/0215167 to Crooks, et al., which is incorporated herein by reference in its entirety.

The substrate material can incorporate tobacco of some form, normally is composed predominantly of tobacco, and can be provided by virtually all tobacco material. The form of the substrate material can vary. In some embodiments, the substrate material is employed in an essentially traditional filler form (e.g., as cut filler). The substrate material can be otherwise formed into desired configurations. The substrate material can be used in the form of a gathered web or sheet, using the types of techniques generally set forth in U.S. Pat. No. 4,807,809 to Pryor et al, which is incorporated herein by reference in its entirety. The substrate material can be used in the form of a web or sheet that is shredded into a plurality of longitudinally extending strands, using the types of techniques generally set forth in U.S. Pat. No. 5,025,814 to Raker, which is incorporated herein by reference in its entirety. The substrate material can have the form of a loosely rolled sheet, such that a spiral type of air passageway extends longitudinally through the aerosol-generating segment. Representative types of tobacco containing substrate materials can be manufactured from mixtures of tobacco types; or from one predominant type of tobacco (e.g., a cast sheet-type or paper-type reconstituted tobacco composed primarily of burley tobacco, or a cast sheet-type or paper-type reconstituted tobacco composed primarily of Oriental tobacco).

The substrate material also can be treated with tobacco additives of the type that are traditionally used for the manufacture of cigarettes, such as casing and/or top dressing components. See, for example, the types of components set forth in U.S. Pat. Publication 2004/0173229 to Crooks et al, which is incorporated herein by reference in its entirety.

The manner by which the aerosol-forming material is contacted with the substrate material (e.g., the tobacco material) can vary. The aerosol-forming material can be applied to a formed tobacco material, or can be incorporated into processed tobacco materials during manufacture of those materials. The aerosol-forming material can be dissolved or dispersed in an aqueous liquid, or other suitable solvent or liquid carrier, and sprayed onto that substrate material. See, for example, U.S. Patent Application Pub. No. 2005/0066986 to Nestor et al, which is incorporated herein by reference in its entirety. The amount of aerosol-forming material employed relative to the dry weight of substrate material can vary. Materials including exceedingly high levels of aerosol-forming material can be difficult to process into cigarette rods using conventional types of automated cigarette manufacturing equipment.

Cast sheet types of materials may incorporate relatively high levels of aerosol-forming material. Reconstituted tobaccos manufactured using paper-making types of processes may incorporate moderate levels of aerosol-forming material. Tobacco strip and tobacco cut filler can incorporate lower amounts of aerosol-forming material. Various paper and non-paper substrates including gathered, laminated, laminated metal/metallic, strips, beads such as alumina beads, open cell foam, foamed monolith, air permeable matrices, and other materials can be used within the scope of the invention. See, for example, U.S. Pat. Nos. 5,183,062; 5,203,355; and 5,588,446; each to Clearman, and each of which is incorporated herein by reference.

In other embodiments, the substrate portion of an aerosol-generation segment may include or may be constructed from an extruded or other monolithic material. An extruded substrate may be formed in the same manner as described herein with reference to other extruded components. The extruded or other monolithic substrate may include, or may be essentially comprised of, tobacco, glycerin, water, and binder material. In certain embodiments, a monolithic substrate may include about 10 to about 90 weight-percent tobacco, about 5 to about 50 weight-percent glycerin, about 1 to about 30 weight-percent water (before being dried and cut), and about 0 to about 10 weight-percent binder. It may also include a filler such as, for example, calcium carbonate and/or graphite.

Following extrusion, drying, and cutting to a desired length, the substrate may be assembled into a segmented smoking article such as an Eclipse-type cigarette using a manual assembly method or a cigarette-making machine (e.g., KDF or Protus by Hauni Maschinenbau AG). Smaller diameter monolithic substrate elements may be combined by being wrapped, adhered, or otherwise assembled together for use in a smoking article as described for other substrate embodiments herein. Preferred substrate wraps include foil paper, heavy-gauge paper, plug wrap, and/or cigarette paper.

Figure 4:
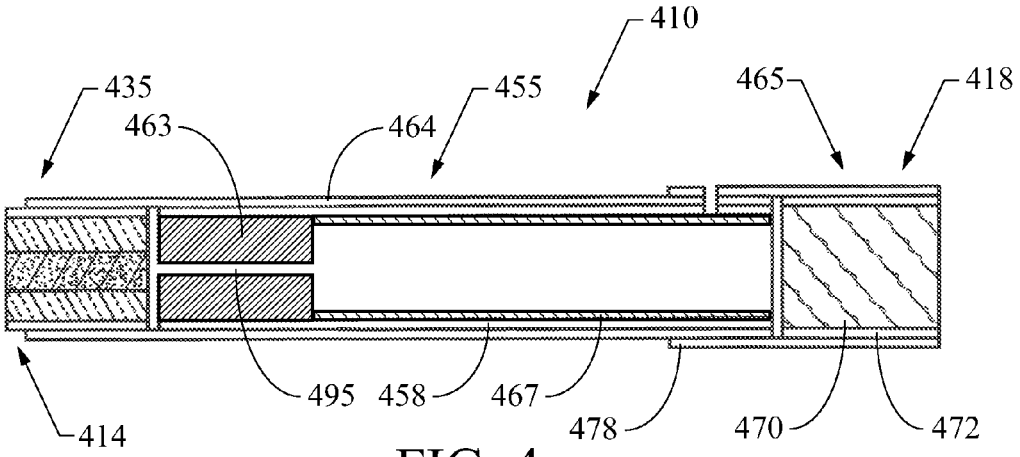
FIGS. 4-6 each show a longitudinal cross-sectional view of a representative smoking article including a monolithic substrate.

In one embodiment, a smoking article may be constructed with a monolithic substrate 463, described here with reference to FIG. 4, which is a longitudinal section view of a cigarette 410 having a lighting end 414 and a mouth end 418. The monolithic substrate 463 (which may be used in other embodiments such as, for example, those discussed with reference to FIGS. 1 and 2) may be formed by any appropriate extrusion method and is shown with a center-hole 495 extending longitudinally therethrough. The monolithic substrate, cut to length may comprise about 1/16 to about 5/8 of the total length of the cigarette, often about 1/10 to about 1/2 thereof (e.g., a 10 mm, 12 mm, or 50 mm long substrate element in an 85 mm or 130 mm long cigarette). The substrate segment 455 of the cigarette body includes a hollow spacing tube 467 disposed between the substrate 463 and the filter 470. The filter 470 is shown as constructed with overlying layers of plug wrap 472 and tipping paper 478. The substrate 463 and tube 467 are surrounded by a wrapping material 458, which may be configured—for example—as a heat-conducting material (e.g., foil paper), heavy-gauge paper, plug wrap, or cigarette paper. A cylindrically-encompassing wrapping material 464 (such as, for example, cigarette paper or heavy-gauge paper) may be provided to connect the heat-generation segment 435, central substrate segment 455, and filter segment 465. The heat-generation segment 435 and other components may be constructed as described herein and elsewhere in this and other embodiments configured to be practiced within the scope of the present invention.

Figure 5:
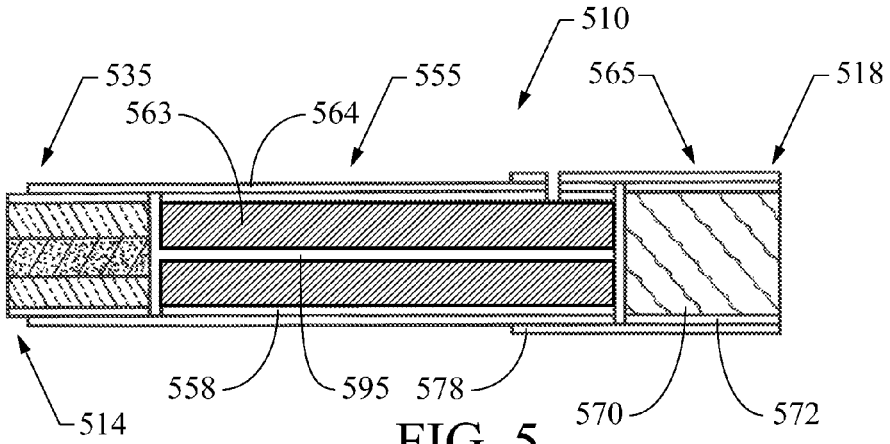

In another embodiment, a smoking article may be constructed with an elongate monolithic substrate 563, described here with reference to FIG. 5, which is a longitudinal section view of a cigarette 510 having a lighting end 514 and a mouth end 518. The elongate monolithic substrate 563 (which may be used in other embodiments) may be formed by any appropriate extrusion method and is shown with a center-hole 595 extending longitudinally therethrough. The filter 570 is shown as constructed with overlying layers of plug wrap 572 and tipping paper 578. The substrate 563 is surrounded by a wrapping material 558, which may be configured—for example—as a heat-conducting material (e.g., foil paper), heavy-gauge paper, plug wrap, or cigarette paper. A cylindrically-encompassing wrapping material 564 (such as, for example, cigarette paper or heavy-gauge paper) may be provided to connect the heat-generation segment 535, central substrate segment 555 (consisting essentially of the substrate in this embodiment), and filter segment 565. The heat-generation segment 535 and other components may be constructed as described herein and elsewhere in this and other embodiments configured to be practiced within the scope of the present invention.

Figure 6:
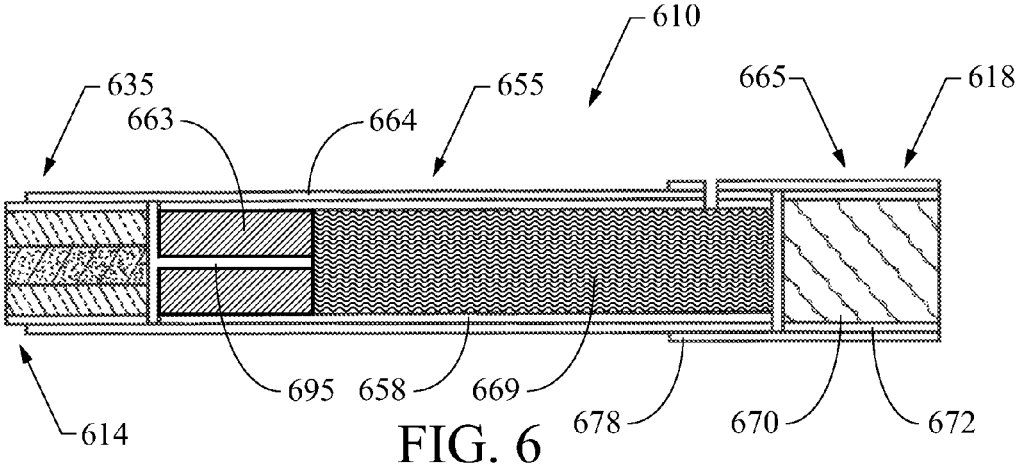

In one embodiment, a smoking article may be constructed with a monolithic substrate 663, described here with reference to FIG. 6, which is a longitudinal section view of a cigarette 610 having a lighting end 614 and a mouth end 618. The monolithic substrate 663 (which may be used in other embodiments) may be formed by any appropriate extrusion method and is shown with a center-hole 695 extending longitudinally therethrough. The cigarette body includes a tobacco rod 669 disposed between the substrate 663 and the filter 670. The filter 670 is shown as constructed with overlying layers of plug wrap 672 and tipping paper 678. The substrate segment 655, formed by the substrate 663 and tobacco rod 669, is surrounded by a wrapping material 658, which may be configured—for example—as a heat-conducting material (e.g., foil paper), heavy-gauge paper, plug wrap, or cigarette paper. A cylindrically-encompassing wrapping material 664 (such as, for example, cigarette paper or heavy-gauge paper) may be provided to connect the heat-generation segment 635, central substrate segment 655, and filter segment 665. The heat-generation segment 635 and other components may be constructed as described herein and elsewhere in this and other embodiments configured to be practiced within the scope of the present invention.

Figure 7:
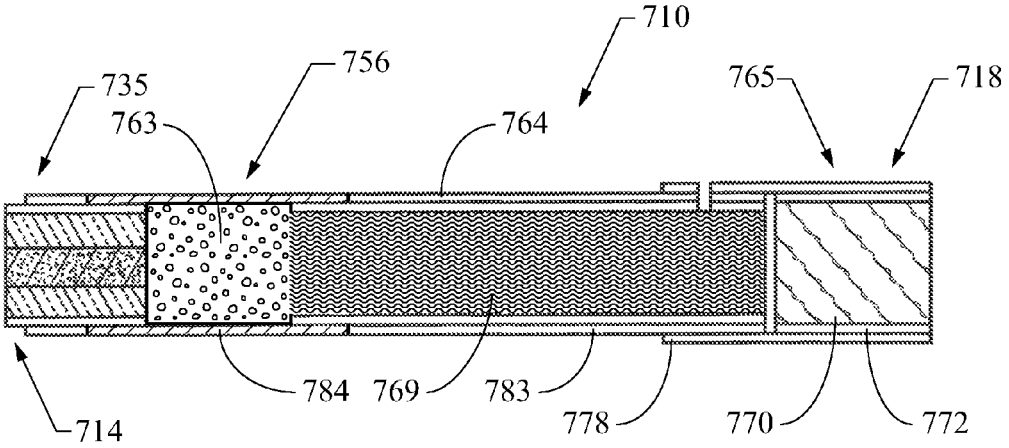
FIG. 7 shows a longitudinal cross-sectional view of a representative smoking article including a tobacco pellet substrate.

In another embodiment, a smoking article may be constructed with a substrate 763 including tobacco pellets, described here with reference to FIG. 7, which is a longitudinal section view of a cigarette 710 having a lighting end 714 and a mouth end 718. The substrate 763 (which may be used in other embodiments) may be formed by any appropriate method, such as a marumarization method. The cigarette body includes a tobacco rod 769 disposed between the substrate 763 and the filter 770. The filter 770 is shown as constructed with overlying layers of plug wrap 772 and tipping paper 778. The heat-generation segment 735 and other components may be constructed as described herein and elsewhere in this and other embodiments configured to be practiced within the scope of the present invention.

The substrate 763 may be contained within a substrate cavity 756. The substrate cavity 756 may be formed by the heat-generation segment 735 at one end, the tobacco rod 769 at the opposite end, and a wrapping material 764 around the circumference of at least the substrate (and—in some embodiments—extending along an entire length from the filter to the lighting end). A cylindrical container structure (not shown) may circumferentially encompass the substrate cavity 756 within the wrapping material 764 and between the heat-generation segment 735 at one end and the tobacco rod 769 at the opposite end. The heat-generation segment 735 and the tobacco rod 769 may be joined to one another by the wrapping material 764. To that end, the wrapping material 764 may circumscribe at least a downstream portion of the heat-generation segment 735 and at least an upstream portion of the tobacco rod 769. The heat-generation segment 735 and the tobacco rod 769 may be spaced longitudinally from one another. In other words, the heat-generation segment 735 and the tobacco rod 769 may not be in abutting contact with one another. The substrate cavity 756 may be defined by a space extending longitudinally within the wrapping material 764 between the downstream end of the heat-generation segment 735 and the upstream end of the tobacco rod 769 as shown in FIG. 7. The substrate 763 may be positioned within the substrate cavity 756. For example, the substrate cavity 756 may be at least partially filled with tobacco pellets. The substrate cavity 756 may contain the substrate 763 to prevent migration of the tobacco pellets.

The wrapping material 764 may be configured, for example, as a heat-conducting material (e.g., foil paper), insulating material, heavy-gauge paper, plug wrap, cigarette paper, tobacco paper, or any combination thereof. Additionally, or alternatively, the wrapping material 764 may include foil, ceramic, ceramic paper, carbon felt, glass mat, or any combination thereof. Other wrapping materials known or developed in the art may be used alone or in combination with one or more of these wrapping materials. In one embodiment, the wrapping material 764 may include a paper material having strips or patches of foil laminated thereto. The wrapping material 764 may include a paper sheet 783. The paper sheet 783 may be sized and shaped to circumscribe the heat-generation segment 735, the substrate cavity 756, and the tobacco rod 769 as described above. To that end, the paper sheet 783 may be substantially rectangular in shape with a length extending along the longitudinal direction of the smoking article and a width extending in a direction transverse to the longitudinal direction. The width of the paper sheet 783 may be slightly larger than the circumference of the smoking article 710 so that the paper sheet may be formed into a tube or a column defining an outer surface of the smoking article. For example, the width of the paper sheet 783 may be from about 18 to about 29 mm. The length of the paper sheet 783 may be sufficient to extend longitudinally along an entire length of the substrate cavity 764 and to overlap the heat-generation segment 735 and the tobacco rod 769. For example, the length of the paper sheet 783 may be about 50 to about 66 mm. The paper sheet 783 may have a length sufficient to overlap substantially an entire length of the tobacco rod 769 as shown in FIG. 7. In one example, the paper sheet (or other wrapping material) may have a thickness of about 1 mil to about 6 mil (about 0.025 mm to about 0.15 mm).

A foil strip or patch 784 may be laminated to the paper sheet 783 to form a laminated coated region. The foil strip 784 may have a width extending along substantially the entire width of the paper sheet 783 to circumscribe substantially the entire circumference of the heat-generation segment 735, the substrate cavity 764, and the tobacco rod 769 as further described below. The foil strip 784 also may have a length extending along a portion of the length of the paper sheet 783. Preferably, the foil strip 784 may extend along a sufficient portion of the length of the paper sheet 783 such that the foil strip extends along the entire length of the substrate cavity 756 and overlaps at least a portion of the heat-generation segment 735 and the tobacco rod 769. For example, the length of the foil strip 784 may be from about 16 to about 20 mm. In one example, the foil strip may have a thickness of about 0.0005 mm to about 0.05 mm.

The foil strip may be laminated on an interior or an exterior surface of the paper sheet. The foil strip may be laminated on the paper sheet using any now known or future developed technique including, for example, heat laminating. The foil strip may be laminated on the paper sheet using any now known or future developed adhesive. In one example, the adhesive may be configured as a cold glue adhesive of the type used to secure tipping materials to other components of a cigarette. The foil strip may be laminated or patched to the paper sheet with or without a lubricant. Preferably, the foil strip may be laminated to the interior surface of the paper sheet (e.g., the surface of the paper sheet that faces toward the substrate cavity) to contact the heat-generation segment, the substrate material, and/or the tobacco rod. The laminated paper or other wrapping material may be constructed in accordance with the disclosure of U.S. Pat. No. 6,849,085 to Marton, which is incorporated herein by reference in its entirety, or in accordance with other appropriate methods and/or materials. For example, the foil strip may circumferentially encompass and extend lengthwise along at least a lengthwise portion of the substrate cavity and may overlap at least a lengthwise portion of the heat generation segment and/or a lengthwise portion of the tobacco rod. The foil strip may enhance heat transfer between the heat-generation segment 735 and the substrate 763. Such enhanced heat transfer may aid in volatilizing the aerosol-forming material in the substrate 763 for aerosol formation. To that end, the foil strip 784 may be formed from a heat conducting material. The foil strip 784 may be formed from any heat conducting material including, for example, tin, aluminum, copper, gold, brass, other thermoconductive materials, and/or any combination thereof. In this manner, the substrate cavity 756 may be defined by a foil-lined paper tube or column formed by the wrapping material 764. The wrapping material may include a registered facing of the foil strip at a discrete location on the wrapping material.

An intermediate segment of a smoking article may include a heat-generation segment, a substrate segment (e.g., a monolithic substrate or a substrate cavity including pellets or beads of substrate material), and a tobacco rod. It may be desirable to provide such an intermediate segment from so-called "two-up" rods that may be handled using conventional-type or suitably modified cigarette rod handling devices, such as tipping devices available as Lab MAX, MAX, MAX S or MAX 80 from Hauni-Werke Korber & Co. KG. See, for example, the types of devices set forth in U.S. Pat. No. 3,308,600 to Erdmann et al.; U.S. Pat. No. 4,281,670 to Heitmann et al.; U.S. Pat. No. 4,280,187 to Reuland et al.; U.S. Pat. No. 4,850,301 to Greene, Jr. et al.; U.S. Pat.

No. 6,229,115 to Vos et al.; U.S. Pat. No. 7,434,585 to Holmes; and U.S. Pat. No. 7,296,578 to Read, Jr.; and U.S. Pat. Appl. Pub. No. 2006/0169295 to Draghetti, each of which is incorporated by reference herein.

Figure 8:
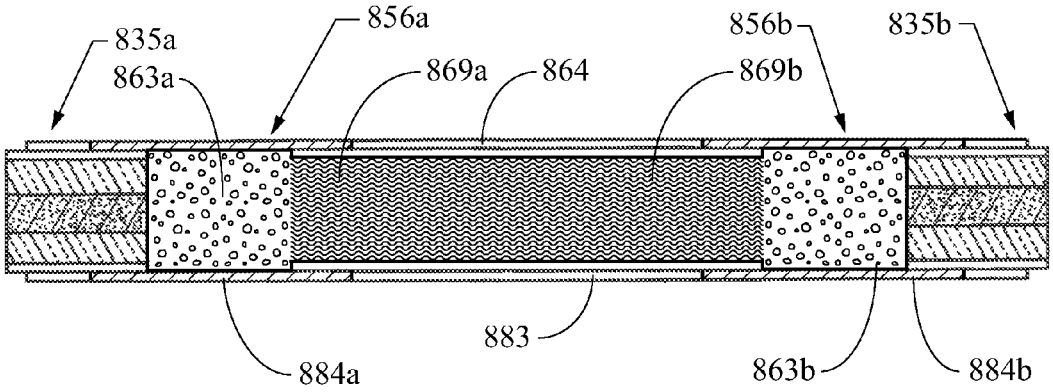
FIG. 8 shows a two-up rod that may be used for manufacturing the smoking article of FIG. 7.

For example, FIG. 8 illustrates a two-up rod that may be produced in the process of manufacturing a smoking article 710 of FIG. 7, or other smoking article described herein. The two-up rod may include two intermediate segments as described above, the intermediate segments being joined to one another at a common tobacco rod. The two-up rod may include two heat-generation segments 835*a*, 835*b* positioned at opposite longitudinal ends thereof. A tobacco rod 869 may be substantially centered along the longitudinal axis of the rod. The tobacco rod 869 may include two portions 869*a*, 869*b* each associated with one intermediate segment. The tobacco rod 869 and the two heat-generation segments 835*a*, 835*b* may be joined to one another with wrapping material 864 as described above with reference to FIG. 7. A substrate cavity 856*a* may be defined within the wrapping material 864 between the heat-generation segment 835*a* and the tobacco rod 869. A substrate 863*a* may be contained within the substrate cavity 856*a*. Likewise, a substrate cavity 856*b* may be defined within the wrapping material 864 between the heat-generation segment 835*b* and the tobacco rod 869. A substrate 863*b* may be contained within the substrate cavity 856*b*. The wrapping material 864 may include a paper sheet 883 with foil strips 884*a*, 884*b* laminated thereto. The foil strips may be generally aligned with the substrate cavities as described above with reference to FIG. 7. The rod may be severed at about its longitudinal center to form two intermediate segments, each generally configured as described above. A tobacco rod, a hollow tube, and/or a filter element may be attached to the downstream end of each intermediate segment by any means to form a smoking article as described above. The method may include providing the wrapping material circumscribing at least a portion of the heat generation segment, the substrate cavity, the tobacco rod, the second substrate cavity, and at least a portion of the second heat generation segment, a second foil strip of the wrapping material circumscribing the second substrate cavity, wherein the foil strip and the second foil strip are registered at a discrete interval apart from each other, said interval calibrated to accurately and repeatably dispose the foil strip and the second foil strip at a desired location relative to the substrate cavity, the second substrate cavity, the heat generation segment, and the second heat generation segment.

Such a two-up rod and/or an intermediate segment may facilitate handling of the substrate material during manufacturing of a smoking article. For example, a two-up rod and/or an intermediate segment may be processed using standard processing equipment as described above while retaining the tobacco pellets substrate 863 between the heat generation segment 835 and the tobacco rod 869 and within the substrate cavity 856. In other words, the tobacco pellets substrate may be contained within the two-up rod and/or intermediate segment so that further processing may be completed while avoiding migration and/or loss of the tobacco pellets substrate.

Figure 9:
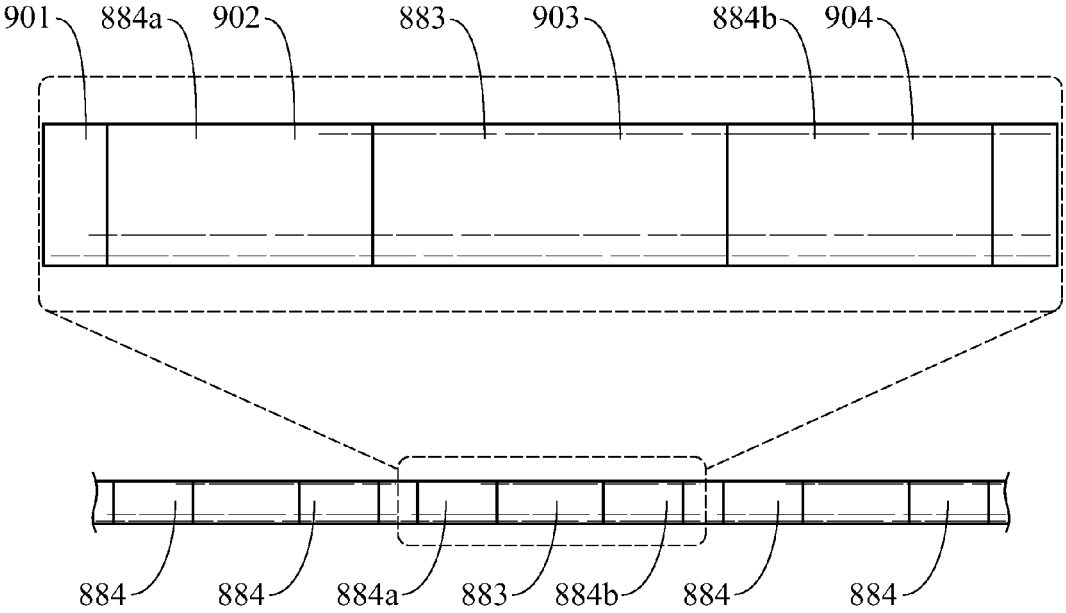
FIG. 9 shows a wrapping material that may be used for manufacturing the two-up rod of FIG. 8.

The wrapping material 864 may be provided as a continuous tape of material having foil strips 884 laminated thereto in a repeating pattern. FIG. 9 illustrates a portion of the tape of wrapping material 864 including one repeat unit of the repeating pattern. In certain preferred embodiments, foil strips 884 may be precisely registered along the wrapping material 864 such that each foil strip will align with a substrate cavity as described above when the wrapping material is used to form the two-up rods also as described above.

In one example, a repeat unit of the repeating pattern may include a series of segments extending in a longitudinal direction along the wrapping material 864. A first segment 901 may include unlaminated paper. In other words, the first segment 901 may include paper material without a foil strip laminated thereto. The first segment may have a length of about 4 to about 8 mm. A second segment 902 may extend longitudinally from the first segment 901 and may include foil laminated paper. In other words, the second segment 902 may include paper material with a foil strip laminated thereto, such that the paper material (or other wrapping material) is continuous, with precisely registered foil strips laminated thereto at discrete predetermined location intervals. The second segment 902 may have a length of about 16 to about 20 mm. A third segment 903 may extend longitudinally from the second segment 902 and may include unlaminated paper. The third segment 903 may have a length of about 14 to about 18 mm. A fourth segment 904 may extend longitudinally from the third segment 903 and may include foil laminated paper. The fourth segment 904 may have a length of about 16 to about 20 mm.

The repeat unit may be repeated any number of times to form a tape of wrapping material 864 having any length appropriate for use on a bobbin or other structure configured to provide wrapping material to a cigarette assembly machine. As will be recognized by one of ordinary skill in the art, the positioning of the foil strips along the wrapping material preferably will be precisely controlled. Any variation in the positioning may lead to misalignment between a foil strip and a substrate cavity. The tape of wrapping material may be severed, for example, at approximately the longitudinal center of the first segment 901 to form a piece of wrapping material suitable for assembling a single two-up rod as described above. Optical monitoring devices and/or other monitoring devices may be included in or with an assembly machine and incorporated into its operation to maintain accurate alignment/registration of the foil segments with other smoking article components (e.g., heat element segment, substrate segment) during assembly of smoking articles.

Figure 10:
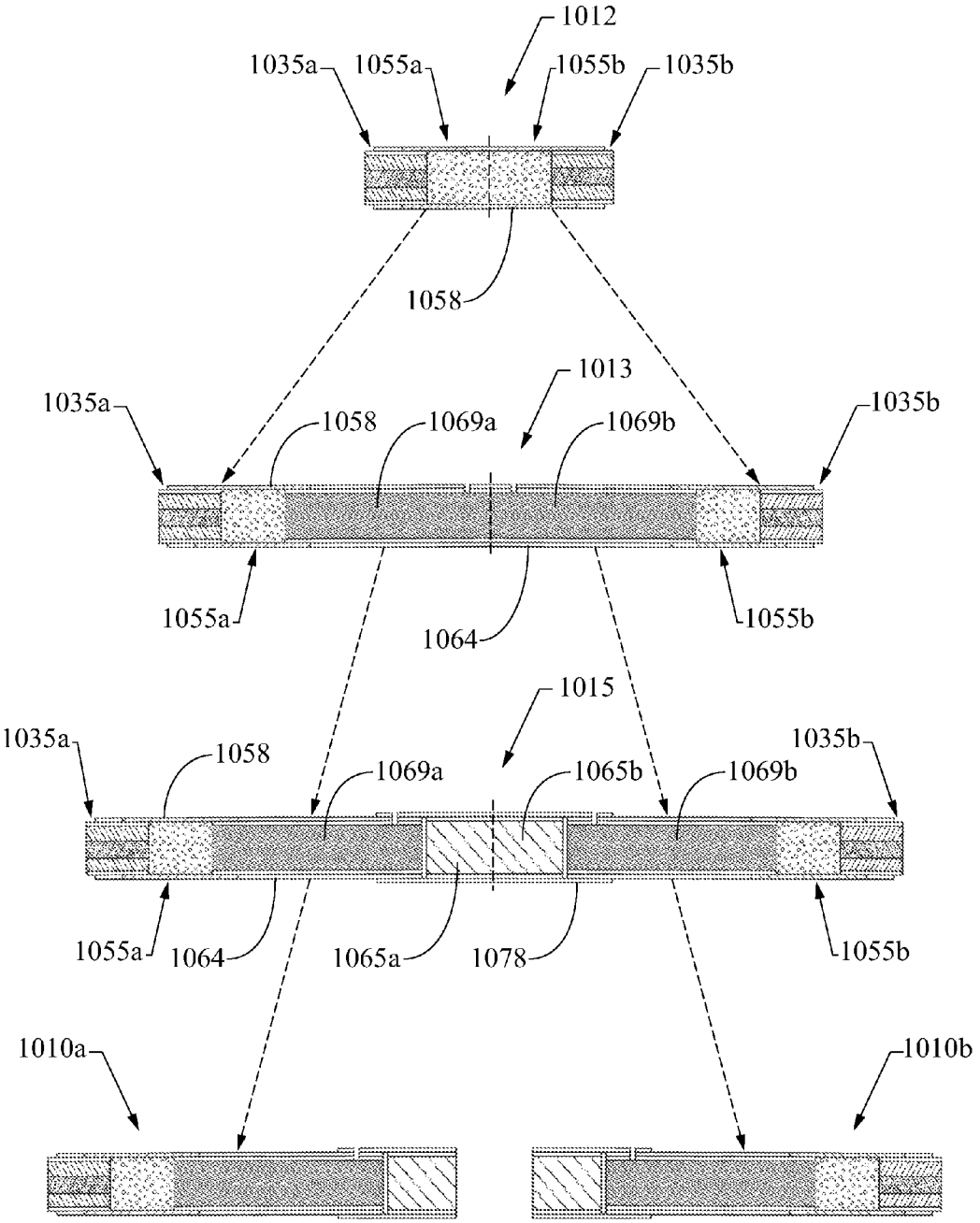
FIG. 10 shows one example of the construction of a smoking article.

FIG. 10 illustrates another example of the construction of a smoking article using a two-up rod. A two-up aerosol generation segment 1012 may be provided. The two-up aerosol generation segment may include two aerosol generation segments joined to one another. For example, the two-up aerosol generation segment 1012 may include two heat generation segments 1035*a*, 1035*b* positioned at opposite longitudinal ends thereof. A substrate segment 1055 may be substantially centered between the heat generation segments 1035*a*, 1035*b* along the longitudinal axis of the two-up aerosol generation segment 1012. The substrate segment 1055 may include two substrate segments 1055*a*, 1055*b* each associated with one aerosol generation segment. The heat generation segments 1035*a*, 1035*b* and the substrate segments 1055*a*, 1055*b* may be joined to one another by a circumscribing wrapping material 1058. The wrapping material 1058 may be constructed as described herein and elsewhere in this and other embodiments configured to be practiced within the scope of the present invention. For example, the wrapping material 1058 may circumscribe at least a portion of the heat generation segment 1035*a*, the substrate segments 1055*a*, 1055*b*, and at least a portion of the second heat generation segment 1035*b*. The wrapping material 1058 may include a foil strip laminated thereto as described above. The foil strip may enhance heat transfer between the heat generation segments and the substrate segments.

The components of the two-up aerosol generation segment 1012 may be constructed as described herein and elsewhere in this and other embodiments configured to be practiced within the scope of the present invention. For example, the substrate segment may include any type of substrate including, for example, a monolithic substrate or tobacco pellet substrate. The substrate segment may be formed as a single segment of substrate material (e.g., a single piece of extruded monolithic substrate material or a single segment of tobacco pellet substrate material) or multiple segments of substrate material (e.g., two or more pieces of extruded monolithic substrate material or two or more segments of tobacco pellet substrate material). The substrate may be disposed within a cylindrical container structure. For example, the substrate segment 1055 may include two segments 1055*a*, 1055*b* each including a substrate cavity or container at least partially filled with tobacco pellet substrate material. The substrate cavity or container may be defined by the wrapping material 1058. Alternatively, a discrete substrate cavity or container may be disposed within the wrapping material 1058.

The two-up aerosol generation segment 1012 may be severed at about its longitudinal center to form two heat generation segments, each generally configured as described above. The two heat generation segments may be positioned at opposite ends of a tobacco rod 1069, as shown in FIG. 10, to form a two-up rod 1013. The two-up rod 1013 may be configured generally as described with reference to FIG. 8. For example, the two-up rod 1013 may include two intermediate segments joined to one another at a common tobacco rod as described above. The tobacco rod 1069 may include two portions 1069*a*, 1069*b* each associated with one intermediate segment. The tobacco rod 1069 and the two aerosol generation segments may be joined to one another with wrapping material 1064. The wrapping material 1064 may circumscribe at least a portion of each aerosol generation segment (e.g., at least a portion of the substrate segments 1055*a*, 1055*b* and/or at least a portion of the heat generation segments 1035*a*, 1035*b*) and the tobacco rod 1069.

The two-up rod may be severed at about its longitudinal center to form two intermediate segments. The two intermediate segments may be positioned at opposite ends of a filter segment 1065, as shown in FIG. 10, to form a two-up cigarette rod 1015. The two-up cigarette rod may include two intermediate segments joined to one another at a common filter segment 1065. The filter segment 1065 may include two portions 1065*a*, 1065*b* each associated with one cigarette rod. The filter segment 1065 and the two intermediate segments may be joined to one another with wrapping material 1078. For example, wrapping material 1078 may circumscribe at least a portion of each intermediate segment (e.g., a portion of each tobacco rod 1069*a*, 1069*b*) and the filter segment 1065. The wrapping material 1078 may be configured as a tipping material as described above. The two-up cigarette rod may be severed at about its longitudinal center (i.e., at about the longitudinal center of the filter segment 1065) to form two smoking articles 1010*a*, 1010*b*. The smoking articles may be constructed as described herein and elsewhere in this and other embodiments configured to be practiced within the scope of the present invention.

Figure 11:
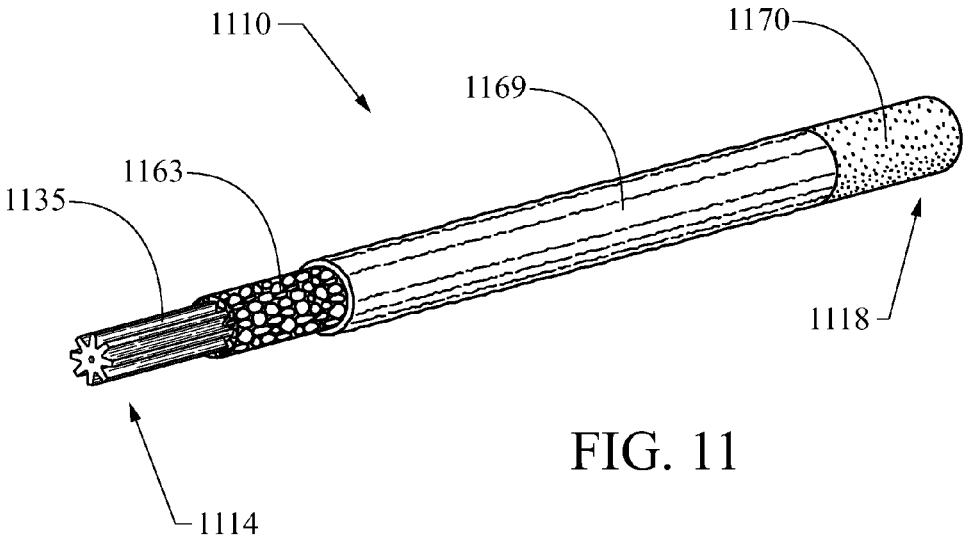
FIG. 11 shows a representative smoking article including a tobacco pellet substrate.

In another embodiment, a smoking article may be constructed with a substrate 1163 including tobacco pellets, described here with reference to FIG. 11, which is a partial perspective view of a cigarette 1110 having a lighting end 1114 and a mouth end 1118. The substrate 1163 (which may be used in other embodiments) may be formed by any appropriate method, such as a marumarization method. The cigarette body includes a tobacco rod 1169 disposed between the substrate 1163 and the filter 1170. The heat-generation segment 1135 and other components may be constructed as described herein and elsewhere in this and other embodiments configured to be practiced within the scope of the present invention. For example, the heat-generation segment 1135 may include one or more grooves formed in an outer surface thereof. The grooves may extend longitudinally along the outer surface of the heat-generation segment 1135. In one preferred embodiment, the heat-generation segment 1135 may include 8 grooves disposed around an outer circumference thereof. The heat-generation segment also may include one or more longitudinal channels formed therethrough. The grooves and/or channels may provide a desired airflow through the heat-generation segment 1135. To that end, any number of grooves and/or channels may be included, and the grooves and/or channels may have any desired shape or size. For example, the grooves and/or channels may be configured as described in U.S. Pat. App. Publ. No. 2012/0042885 to Stone et al., which is incorporated by reference herein in its entirety.

Figure 12:
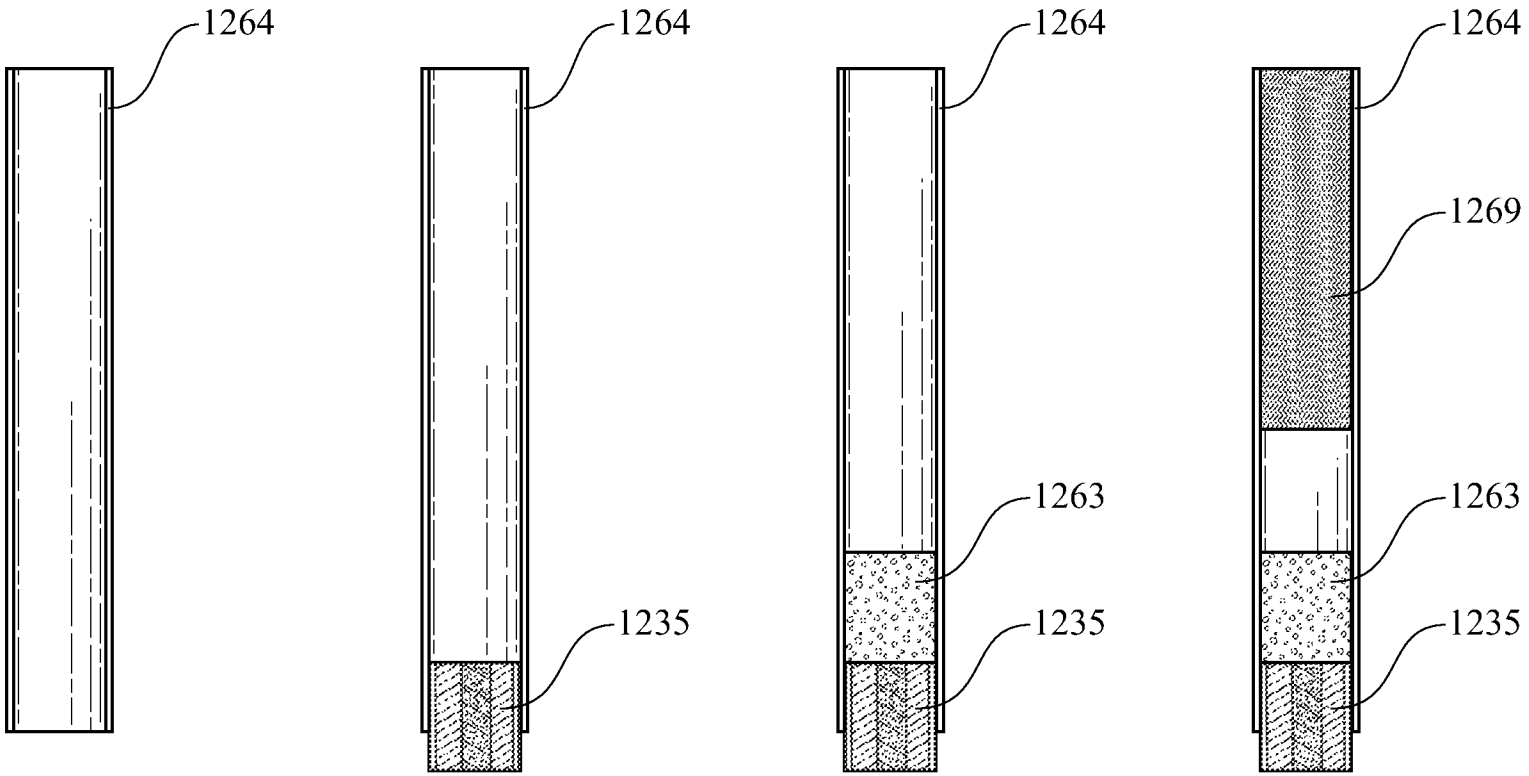
FIG. 12 shows another example of the construction of a smoking article.

FIG. 12 illustrates another example of the construction of a smoking article. A wrapping material 1264 may be formed into a tube or column. The wrapping material 1264 may be constructed as described herein and elsewhere in this and other embodiments configured to be practiced within the scope of the present invention. For example, the wrapping material 1264 may include a paper material having one or more foil strips or patches laminated to a surface thereof. The foil strips may be arranged to align with various portions of the smoking article as further described herein. A heat generation segment 1235 may be inserted into the upstream end of the tube. The heat generation segment 1235 may be advanced downstream within the tube until at least a portion of the heat generation segment is received within and/or circumscribed by the tube. The heat generation segment 1235 may be advanced downstream within the tube until substantially the entire heat generation segment is positioned within the tube. Alternatively, a portion of the heat generation segment 1235 may protrude from the upstream end of the tube as shown in FIG. 12.

A substrate material 1263 may be introduced into the downstream end of the tube. The substrate material 1263 may be advanced upstream within the tube to a position proximate the heat generation segment 1235. The heat generation segment 1235 and the substrate material 1263 may cooperatively form an aerosol-generation system as described above. The substrate material 1263 may be constructed as described herein and elsewhere in this and other embodiments configured to be practiced within the scope of the present invention. For example, the substrate material may be configured as a tobacco pellet substrate material as described above. A segment of the tube positioned adjacent the heat generation segment 1035 may be at least partially filled with the tobacco pellet substrate material. In other words, the tobacco pellet substrate material may be dispensed into a segment of the tube positioned downstream and adjacent the heat generation segment 1035 to at least partially fill the segment of the tube. In this manner, the segment of the tube may be configured as a container or capsule to receive the tobacco pellet substrate material 1263. The tube may be placed in a vertical configuration during introduction of the substrate material, with the heat generation segment 1235 positioned at the bottom end of the vertical tube. In this manner, the heat generation segment 1235 may be used to plug the bottom end of the tube. The substrate material may be introduced into the top end of the vertical tube and allowed to fill a segment of the tube above the heat generation segment 1235.

A tobacco rod 1269 may be introduced into the downstream end of the tube. The tobacco rod may be advanced upstream within the tube to be positioned proximate the substrate material 1263. In this manner, a substrate cavity or compartment may be formed by the heat generation segment 1235, the tube of wrapping material 1264, and the tobacco rod 1269. The substrate cavity may be configured as described above with reference to FIG. 7. With the substrate material 1263 confined within the tube between the heat generation segment 1235 and the tobacco rod 1269, further processing of the components of the smoking article may be performed while retaining the substrate material within the tube. In other words, the substrate material may be substantially unable to migrate within or out of the wrapping material tube during further processing steps.

The heat generation segment 1235, the substrate material 1263, and/or the tobacco rod 1269 may be attached to one another with the wrapping material tube. The tobacco rod 1269 may help to retain the substrate material 1263 within the wrapping material tube for further processing. In one example, a second tobacco rod, a hollow filter, or both may be introduced into the downstream end of the tube and advanced upstream within the tube to be positioned proximate the tobacco rod 1269. The second tobacco rod may include multiple (e.g., two or more) tobacco rods of the same or different types of tobacco. The lengths of the tobacco rod 1269, a second tobacco rod, and/or the hollow filter may affect (e.g., reduce) the temperature and/or the sensory properties of the aerosol drawn therethrough. In one example the tobacco rod 1269 may have a length ranging from about 5 mm to about 20 mm. In one example, a second tobacco rod, a hollow filter, or both may have a length ranging from about 10 mm to about 40 mm. Thus, an intermediate segment, which may be configured generally as described above with reference to FIGS. 7-8, may be formed. A tobacco rod, a hollow tube, and/or a filter element may be attached to the downstream end of the tube by any means to form a smoking article as described above. The wrapping material tube may circumscribe at least a portion of the heat generation segment, the substrate material, and at least a portion of the tobacco rod. A foil strip, which may be laminated to a surface of the wrapping material, may circumscribe the substrate material as described above.

In other embodiments, a tobacco pellet substrate or an extruded or other monolithic substrate may be used in place of the substrates discussed herein with reference, for example, to FIGS. 1 and 2. For example, in one embodiment, the substrate 55 of FIG. 1 may be replaced with a tobacco pellet substrate disposed within a substrate cavity or a monolithic substrate having one or more internal longitudinal channels and/or one or more external grooves. Various other filter designs may be used including perforated filters made of non-cellular acetate materials known in the art, as well as other filter configurations now known or forthcoming, all within the scope of the present invention. The other portions of cigarettes made with tobacco pellet substrates or extruded or other monolithic substrates may also be modified in accordance with the state of the art, and still be practiced within the scope of the present invention.

EXAMPLES 1-4

Composite Tobacco Pellet Samples

In one example, four composite tobacco pellet substrates were formed according to processes described herein, and they included the following components:

| Component | Weight-Percent (Example 1) | Weight-Percent (Example 2) | Weight-Percent (Example 3) | Weight-Percent (Example 4) |
|---|---|---|---|---|
| Tobacco Blend (powder) | 40 | 30 | 20 | 35 |
| Glycerol | 20 | 20 | 20 | 30 |
| $CaCo_3$ | 40 | 50 | 60 | 35 |

The tobacco blend powder was a blend of 50% flue-cured tobacco, 30% burley tobacco, and 20% oriental tobacco. The tobacco was ground to a particle size of about 10 microns. The calcium carbonate was precipitated agglomerated calcium carbonate.

EXAMPLES 5-8

Flavored Composite Tobacco Pellet Samples

In another example, four flavored composite tobacco pellet substrates were formed according to processes described herein, and they included the following components:

| Component | Weight-Percent (Example 5) | Weight-Percent (Example 6) | Weight-Percent (Example 7) | Weight-Percent (Example 8) |
|---|---|---|---|---|
| Tobacco Blend (powder) | 30 | 29.7 | 25 | 25 |
| Glycerol | 20 | 0 | 20 | 20 |
| $CaCo_3$ | 50 | 49.7 | 50 | 50 |
| Coffee (finely ground or instant at 50:50 w/w) | 0 | 0 | 5 | 5 |
| Vanillin (~0.6%) in B3 | 0 | 20.6 | 0 | 0 |

The tobacco blend powder was a blend of 50% flue-cured tobacco, 30% burley tobacco, and 20% oriental tobacco. The tobacco was ground to a particle size of about 10 microns. The calcium carbonate was precipitated agglomerated calcium carbonate.

A binder may be added to any of the examples described above (e.g., Examples 1-8, or any other examples). The binder may include, for example, CMC, a gum (e.g., guar gum), xanthan, pullulan, or an alginate. The binder may be added by a total weight basis, preferably ranging from about 0 to about 15% of the final mixture.

Cigarettes of the present invention may be air-diluted or ventilated such that the amount of air dilution for an air diluted cigarette may be about 10 percent to about 80 percent. As used herein, the term "air dilution" is the ratio (expressed as a percentage) of the volume of air drawn through the air dilution means to the total volume of air and aerosol drawn through the cigarette and exiting the mouth end portion of the cigarette. Higher air dilution levels can act to reduce the transfer efficiency of aerosol-forming material into mainstream aerosol.

Preferred embodiments of cigarettes of the present invention, when smoked, yield an acceptable number of puffs. Such cigarettes normally provide more than about 6 puffs, and generally more than about 8 puffs, per cigarette, when machine-smoked under standardized smoking conditions. Such cigarettes normally provide less than about 15 puffs, and generally less than about 12 puffs, per cigarette, when smoked under standardized smoking conditions. Standardized smoking conditions consist of 35 ml puffs of 2 second duration separated by 58 seconds of smolder.

Aerosols that are produced by cigarettes of the present invention are those that comprise air-containing components such as vapors, gases, suspended particulates, and the like. Aerosol components can be generated from burning tobacco of some form (and optionally other components that are burned to generate heat); by thermally decomposing tobacco caused by heating tobacco and charring tobacco (or otherwise causing tobacco to undergo some form of smolder); and by vaporizing aerosol-forming agent. As such, the aerosol can contain volatilized components, combustion products (e.g., carbon dioxide and water), incomplete combustion products, and products of pyrolysis.

Aerosol components may also be generated by the action of heat from burning tobacco of some form (and optionally other components that are burned to generate heat), upon substances that are located in a heat exchange relationship with tobacco material that is burned and other components that are burned. Aerosol components may also be generated by the aerosol-generation system as a result of the action of the heat generation segment upon an aerosol-generating segment. In some embodiments, components of the aerosol-generating segment have an overall composition, and are positioned within the smoking article, such that those components will have a tendency not to undergo a significant degree of thermal decomposition (e.g., as a result of combustion, smoldering or pyrolysis) during conditions of normal use.

Drawings in the figures illustrating various embodiments are not necessarily to scale. Some drawings may have certain details magnified for emphasis, and any different numbers or proportions of parts should not be read as limiting, unless so-designated by one or more claims. Those of skill in the art will appreciate that embodiments not expressly illustrated herein may be practiced within the scope of the present invention, including that features described herein for different embodiments may be combined with each other and/or with currently-known or future-developed technologies while remaining within the scope of the claims presented here. It is therefore intended that the foregoing detailed description be regarded as illustrative rather than limiting. And, it should be understood that the following claims, including all equivalents, are intended to define the spirit and scope of this invention.

We claim:

1. A cigarette comprising:

a lighting end and a mouth end with a mouth end segment disposed at the mouth end;

a tobacco rod disposed between the lighting end and the mouth end segment;

an aerosol-generation system disposed between the lighting end and the tobacco rod, the aerosol-generation system including a heat generation segment disposed at the lighting end, with a heat source configured to be activated by ignition of the lighting end and an insulation layer of flame-retardant material around a portion of the heat source; and an aerosol-generating segment including a tobacco pellet substrate that is disposed within a first substrate cavity defined between the heat generation segment and the tobacco rod, where the tobacco pellet substrate directly contacts the heat generation segment at one end of the substrate cavity and directly contacts the tobacco rod at the other end of the substrate cavity;

a wrapping material pre-formed as a paper material tube circumscribes the aerosol-generating segment;

wherein the wrapping material comprises a foil strip laminated to a surface of the paper material tube, which foil strip circumferentially encompasses and extends lengthwise along at least a lengthwise portion of the substrate cavity.

2. The cigarette of claim 1, where the surface of the paper material tube to which the foil strip is laminated is an inward-facing surface of the paper material tube.

3. The cigarette of claim 1, wherein the foil strip extends along substantially an entire length of the substrate cavity.

4. The cigarette of claim 1, wherein the wrapping material contacts the heat generation segment and the tobacco rod.

5. A method for making a cigarette according to claim 1, said method comprising steps of:

providing the pre-formed paper material tube including the foil strip;

positioning the heat generation segment adjacent a first end of the tube;

delivering the tobacco pellet substrate into the tube adjacent to and directly contacting the heat generation segment and within first substrate cavity; and delivering the tobacco rod adjacent to and directly contacting the tobacco pellet substrate at an end of the tobacco pellet substrate that is opposite from the heat generation segment.

6. The method of claim 5, where the pre-formed paper material tube is vertically oriented during at least the step of delivering the tobacco pellet substrate.

7. The method of claim 5, adapted to form a two-up rod for assembly of the cigarette, said method further comprising steps of:

providing the pre-formed paper material tube, constructed with a greater length than for a one-up rod;

delivering the second tobacco pellet substrate into the tube within the substrate cavity; and positioning a second heat generation segment adjacent a second end the tube, longitudinally opposite the first end of the tube.

8. The method of claim 7, where the tube is vertically oriented during at least the step of introducing a second tobacco pellet substrate.

9. The method of claim 7, further comprising severing the two-up rod into two intermediate segments.

10. The method of claim 9, further comprising steps of assembling a tobacco rod and a mouth-end segment to the tube of each of the two intermediate segments.

11. The method of claim 5, wherein the step of providing the pre-formed paper material tube comprises a step of forming the pre-formed tube from a paper sheet before the steps of positioning and delivering.

12. The method of claim 11, wherein the foil strip is laminated to the paper sheet before the step of forming the tube.

13. The method of claim 11, where the paper sheet is sized and shaped to circumscribe the at least a portion of the heat generation segment, the aerosol-generating segment, and the at least a portion of the tobacco rod.

14. The method of claim 13, where—before being formed into the pre-formed tube—the paper sheet is substantially rectangular in shape.

15. A cigarette comprising:

a lighting end and a mouth end;

an aerosol-generation system disposed between the lighting end and the mouth end, the aerosol-generation system including a heat generation segment disposed at the lighting end, with a heat source configured to be activated by ignition of the lighting end and an insulation layer of flame-retardant material around a portion of the heat source; and an aerosol-generating segment including a tobacco pellet substrate that is disposed within a substrate cavity defined at one end by the heat generation segment and at an opposite end by a tobacco rod, where the tobacco pellet substrate contacts the heat generation segment and contacts the tobacco rod;

a pre-formed paper wrapping material tube that circumscribes at least a portion of the heat generation segment, the aerosol-generating segment, and at least a portion of the tobacco rod;

a foil strip laminated to an interior surface of the paper wrapping material tube, which foil strip circumferentially encompasses and extends along at least a lengthwise portion of the substrate cavity and overlaps a lengthwise portion of the heat generation segment;

wherein, a first lengthwise portion of the wrapping material comprises unlaminated paper material not covered by the foil strip, an intermediate second lengthwise portion of the wrapping material extends from the first lengthwise portion wherein the foil strip directly contacts and circumferentially encompasses the tobacco pellet substrate, and a third lengthwise portion also comprises unlaminated paper material not covered by the foil strip.

16. A cigarette comprising:

a lighting end and a mouth end with a mouth end segment disposed at the mouth end;

a tobacco rod disposed between the lighting end and the mouth end segment;

an aerosol-generation system disposed between the lighting end and the tobacco rod, the aerosol-generation system including a heat generation segment disposed at the lighting end, with a heat source configured to be activated by ignition of the lighting end and an insulation layer of flame-retardant material around a portion of the heat source; and an aerosol-generating segment including a pre-formed paper material tube to which a foil material is laminated on an inward-facing surface of the paper material tube that defines a first substrate cavity so that the foil material circumferentially encompasses and extends lengthwise along at least a lengthwise portion of the substrate cavity; and a tobacco pellet substrate disposed within the first substrate cavity, further defined at one longitudinal end by the heat generation segment and at an opposite longitudinal end by the tobacco rod, where the tobacco pellet substrate directly contacts the heat generation segment and directly contacts the tobacco rod.

17. The cigarette of claim 16, further comprising heat conductive material extending from the heat source to around the aerosol-generating segment.

18. The cigarette of claim 17, wherein the heat conductive material provides a heat exchange relationship between the heat source and the tobacco pellet substrate disposed within the aerosol-generating segment.

19. The cigarette of claim 16, wherein the tobacco pellet substrate comprises tobacco blend powder, glycerol, and calcium carbonate.

* * * * *